US007322874B2

(12) United States Patent
Ellman et al.

(10) Patent No.: US 7,322,874 B2
(45) Date of Patent: Jan. 29, 2008

(54) EXPRESSION MECHANISM FOR A TOY, SUCH AS A DOLL, HAVING FIXED OR MOVEABLE EYES

(76) Inventors: Steven Ellman, 1672 E. 7th St., Brooklyn, NY (US) 11230; Lawrence Mass, 5 Berkley La., Rye Brook, NY (US) 10573; Fredric Ellman, 30 Fairview Ave., Tarrytown, NY (US) 10591; Julius Ellman, 1672 E. 7th St., Brooklyn, NY (US) 11230

( * ) Notice: Subject to any disclaimer, the term of this patent is extended or adjusted under 35 U.S.C. 154(b) by 0 days.

(21) Appl. No.: 11/141,310

(22) Filed: Jun. 1, 2005

(65) Prior Publication Data

US 2005/0287913 A1 Dec. 29, 2005

Related U.S. Application Data

(60) Provisional application No. 60/575,809, filed on Jun. 2, 2004.

(51) Int. Cl.
*A63H 3/40* (2006.01)

(52) U.S. Cl. ..... 446/345; 446/337

(58) Field of Classification Search ..... 446/300, 446/301, 337, 343, 345, 353
See application file for complete search history.

(56) References Cited

U.S. PATENT DOCUMENTS

| | | | |
|---|---|---|---|
| 962,154 | A | 6/1910 | Lemon |
| 1,193,947 | A | 8/1916 | Trost |
| 1,244,799 | A | 10/1917 | Trost |
| 1,255,889 | A | 2/1918 | Killy |
| 1,268,714 | A | 6/1918 | Hoefler |
| 1,280,055 | A | 9/1918 | McCrosky |
| 1,289,687 | A | 12/1918 | Davidson |
| 1,343,422 | A | 6/1920 | Thomson et al. |

(Continued)

FOREIGN PATENT DOCUMENTS

| | | |
|---|---|---|
| CA | 571688 | 3/1959 |

(Continued)

OTHER PUBLICATIONS

U.S. Appl. No. 11/129,491, filed May 16, 2005, entitled "Tearing Mechanism for a Toy, Such as a Doll, Having Fixed or Moveable Eyes".
Supp. Partial European Search Report in European App. No. EP 05749444.5 (5 pp.).

(Continued)

*Primary Examiner*—John A. Ricci
(74) *Attorney, Agent, or Firm*—Dinesh Agarwal, P.C.

(57) ABSTRACT

An expression mechanism for a toy having a lower lip, a cheek and an eye, includes a support frame, a lip lever pivotally connected to the support frame for engaging the lower lip of a toy, a cheek lever pivotally connected to the support frame for engaging a cheek of the toy, an eye linkage for opening or closing the eye of the toy, and a motor for actuating one of the lip and cheek levers to cause the toy to simulate a facial expression. The lip and cheek levers are interconnected in a manner that when the cheek lever pivots in one direction, the lip lever pivots in a generally opposite direction. The expression mechanism causes the toy to assume various facial expressions, including, but not limited to, smile, frown, and neutral.

62 Claims, 15 Drawing Sheets

U.S. PATENT DOCUMENTS

| | | | | |
|---|---|---|---|---|
| 1,395,984 | A | 11/1921 | McCrosky | |
| 1,545,077 | A | 7/1925 | Watkins | |
| 1,606,716 | A | 11/1926 | Munyard | |
| 1,729,729 | A | 10/1929 | McCrosky | |
| 2,093,684 | A | 9/1937 | Maibaum | |
| 2,111,507 | A | 3/1938 | Hogan | |
| 2,133,636 | A | 10/1938 | Schaeffer | |
| 2,157,763 | A | 5/1939 | Konikoff et al. | |
| 2,159,293 | A | 5/1939 | Schaeffer | |
| 2,196,912 | A | 4/1940 | Gilbraith | |
| 2,197,764 | A | 4/1940 | Marcus | |
| 2,303,246 | A | 11/1942 | Wheeler | |
| 2,638,710 | A | 5/1953 | Ratcliff | |
| 2,675,644 | A | 4/1954 | Senior et al. | |
| 2,689,432 | A | 9/1954 | Beebe | |
| 2,748,530 | A | 6/1956 | Stecker | |
| 2,811,810 | A | 11/1957 | Ostrander | |
| 2,812,615 | A | 11/1957 | Zanca et al. | |
| 2,813,372 | A | 11/1957 | Kirby | |
| 2,819,560 | A | 1/1958 | Cohn | |
| 2,827,734 | A | 3/1958 | Beebe | |
| 2,838,874 | A | 6/1958 | Brudney | |
| 2,888,777 | A | 6/1959 | Kaplan | |
| 2,907,139 | A | 10/1959 | Rekettye | |
| 2,934,856 | A | 5/1960 | Cohn | |
| 2,934,857 | A | 5/1960 | Birnbaum | |
| 2,938,302 | A | 5/1960 | Walss | |
| 2,954,640 | A | 10/1960 | Catalano et al. | |
| 2,954,641 | A | 10/1960 | Washburn | |
| 2,959,890 | A | 11/1960 | Ostrander | |
| 2,961,795 | A | 11/1960 | Baggott | |
| 2,974,265 | A | 3/1961 | Thoma | |
| 2,978,833 | A | 4/1961 | Tancredi | |
| 2,987,771 | A | 6/1961 | Catalano et al. | |
| 2,990,646 | A | 7/1961 | Berger | |
| 2,994,158 | A | 8/1961 | Washburn | |
| 3,016,651 | A | 1/1962 | Brudney | |
| 3,019,551 | A | 2/1962 | Brudney | |
| 3,053,009 | A | 9/1962 | Ostrander | |
| 3,070,921 | A | 1/1963 | Baggott et al. | |
| 3,091,891 | A | 6/1963 | Brudney | |
| 3,106,040 | A | 10/1963 | Ostrander | |
| 3,193,968 | A | 7/1965 | Brudney | |
| 3,209,488 | A | 10/1965 | Brudney | |
| 3,310,908 | A | 3/1967 | Refabert | |
| 3,406,482 | A * | 10/1968 | Ryan et al. | 446/304 |
| 3,412,504 | A | 11/1968 | Crosman | |
| 3,444,645 | A | 5/1969 | Tepper et al. | |
| 3,445,955 | A | 5/1969 | Ryan et al. | |
| 3,477,169 | A | 11/1969 | Gardel et al. | |
| 3,571,968 | A | 3/1971 | Samo | |
| 3,758,983 | A | 9/1973 | Cagen | |
| 3,769,745 | A | 11/1973 | Crosman | |
| 3,789,539 | A | 2/1974 | Cagen | |
| 3,822,500 | A | 7/1974 | Ostrander | |
| 3,839,819 | A | 10/1974 | Hollingsworth et al. | |
| 3,841,020 | A | 10/1974 | Ryan et al. | |
| 3,855,729 | A | 12/1974 | Sapkus et al. | |
| 4,016,535 | A | 4/1977 | Dinlocker | |
| 4,033,071 | A * | 7/1977 | Strongin et al. | 446/177 |
| 4,050,185 | A | 9/1977 | Terzian | |
| 4,057,928 | A | 11/1977 | Terzian | |
| 4,339,889 | A | 7/1982 | Guerrero et al. | |
| 4,356,663 | A | 11/1982 | Terzian | |
| 4,560,363 | A | 12/1985 | Garza et al. | |
| 4,708,689 | A | 11/1987 | Hou | |
| 4,737,131 | A | 4/1988 | Sirota | |
| 4,740,186 | A | 4/1988 | Sirota | |
| 4,799,678 | A | 1/1989 | Terzian et al. | |
| 4,900,287 | A | 2/1990 | Fusi et al. | |
| 4,900,289 | A * | 2/1990 | May et al. | 446/342 |
| 5,002,514 | A | 3/1991 | Takei | |
| 5,083,962 | A | 1/1992 | Pracas | |
| 5,083,965 | A | 1/1992 | Mayem | |
| 5,092,811 | A | 3/1992 | Bergenguer | |
| RE33,933 | E | 5/1992 | Hou | |
| 5,324,225 | A | 6/1994 | Satoh et al. | |
| 5,376,038 | A | 12/1994 | Arad et al. | |
| 5,399,115 | A | 3/1995 | Arad et al. | |
| 5,422,628 | A | 6/1995 | Rodgers | |
| 5,746,602 | A | 5/1998 | Kikinis | |
| 5,842,902 | A | 12/1998 | Liff | |
| 5,881,679 | A | 3/1999 | Hann | |
| 5,902,169 | A | 5/1999 | Yamakawa | |
| 5,941,750 | A | 8/1999 | Pracas | |
| 6,042,450 | A | 3/2000 | Leversedge et al. | |
| 6,068,536 | A | 5/2000 | Madland et al. | |
| 6,149,490 | A | 11/2000 | Hampton et al. | |
| 6,238,262 | B1 | 5/2001 | Pracas | |
| 6,309,275 | B1 | 10/2001 | Fong et al. | |
| 6,319,010 | B1 | 11/2001 | Kikinis | |
| 6,322,420 | B1 | 11/2001 | Daniellian | |
| 6,352,464 | B1 * | 3/2002 | Madland et al. | 446/337 |
| 6,358,111 | B1 | 3/2002 | Fong et al. | |
| 6,371,826 | B1 | 4/2002 | Pestonji | |
| 6,375,535 | B1 | 4/2002 | Fong et al. | |
| 6,394,872 | B1 | 5/2002 | Watanabe et al. | |
| 6,454,626 | B1 * | 9/2002 | An | 446/330 |
| 6,497,604 | B2 | 12/2002 | Fong et al. | |
| 6,497,606 | B2 | 12/2002 | Fong et al. | |
| 6,497,607 | B1 | 12/2002 | Hampton et al. | |
| 6,514,117 | B1 | 2/2003 | Hampton et al. | |
| 6,537,128 | B1 | 3/2003 | Hampton et al. | |
| 6,544,094 | B1 | 4/2003 | Maddocks et al. | |
| 6,544,098 | B1 | 4/2003 | Hampton et al. | |
| 6,565,407 | B1 | 5/2003 | Woolington et al. | |
| 6,599,166 | B2 | 7/2003 | Ellman et al. | |
| 6,652,349 | B1 * | 11/2003 | Wichter | 446/330 |
| 2001/0034180 | A1 | 10/2001 | Fong et al. | |
| 2002/0052163 | A1 | 5/2002 | Fong et al. | |
| 2002/0061700 | A1 | 5/2002 | Chan | |
| 2002/0061708 | A1 | 5/2002 | Fong et al. | |
| 2002/0086607 | A1 | 7/2002 | Chan | |
| 2002/0187722 | A1 | 12/2002 | Fong et al. | |
| 2003/0099919 | A1 | 5/2003 | Love | |
| 2004/0077272 | A1 | 4/2004 | Jurmain et al. | |
| 2004/0127140 | A1 | 7/2004 | Kelly et al. | |
| 2004/0214507 | A1 | 10/2004 | Maddocks et al. | |
| 2005/0054263 | A1 | 3/2005 | Maar | |

FOREIGN PATENT DOCUMENTS

| | | |
|---|---|---|
| CA | 588684 | 12/1959 |
| CA | 630593 | 11/1961 |
| DE | 223397 | 6/1910 |
| DE | 1107571 | 5/1961 |
| DE | 2059236 | 6/1971 |
| EP | 0104007 A1 | 3/1984 |
| EP | 0274449 A2 | 7/1988 |
| EP | 528092 A1 | 2/1993 |
| EP | 529171 A1 | 3/1993 |
| EP | 534032 A1 | 3/1993 |
| EP | 549840 A1 | 7/1993 |
| FR | 2081996 | 12/1971 |
| FR | 2435273 | 4/1980 |
| GB | 761894 | 11/1956 |
| GB | 1258323 | 12/1971 |
| GB | 1395589 | 5/1975 |
| GB | 2068245 A | 8/1981 |
| GB | 2068753 A | 8/1981 |

OTHER PUBLICATIONS

PCT International Search Report and the Written Opinion in International App. No. PCT/US05/19176 (10 pp.).

* cited by examiner

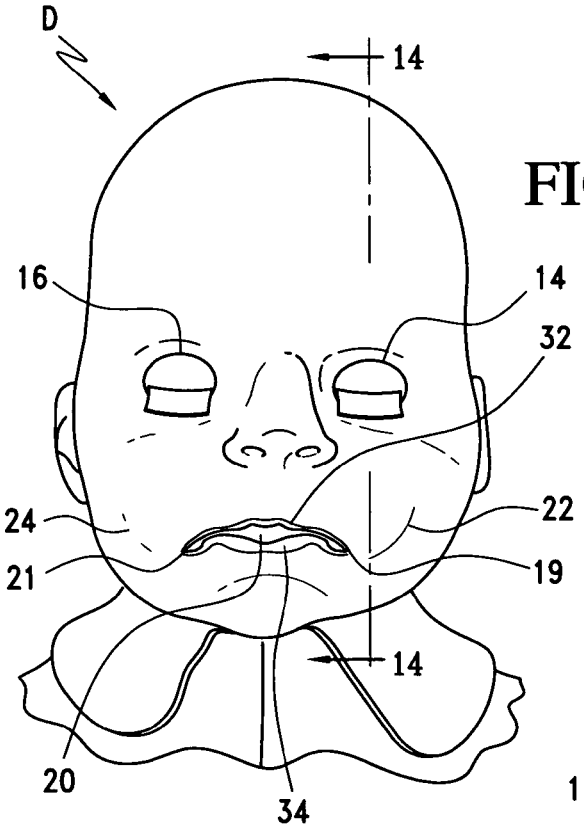
FIG. 11
FIG. 12
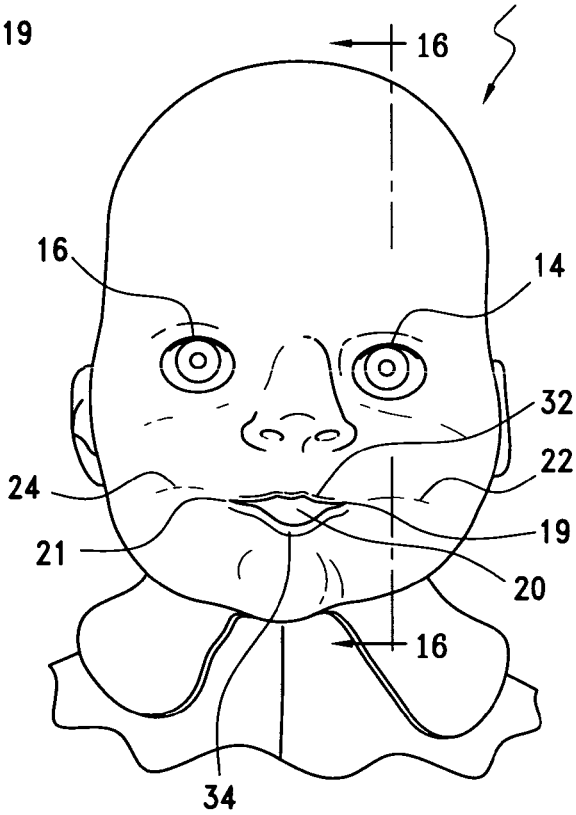
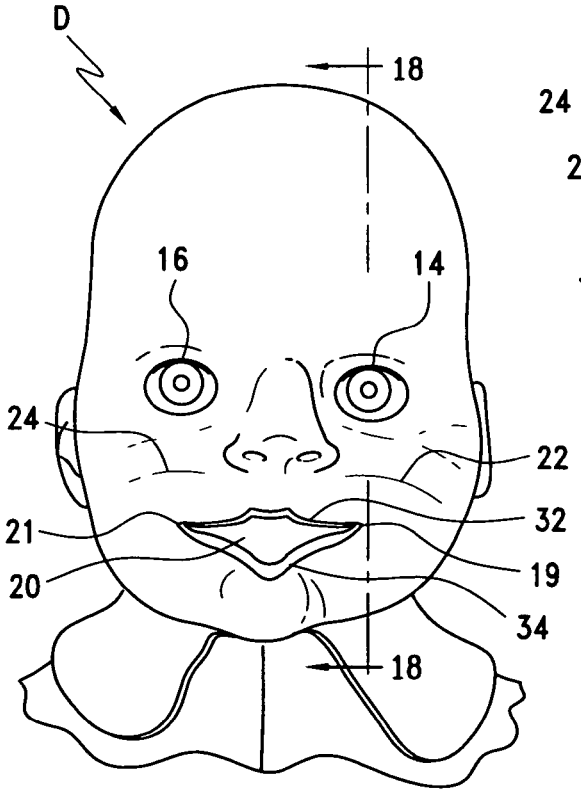
FIG. 13

FIG. 14
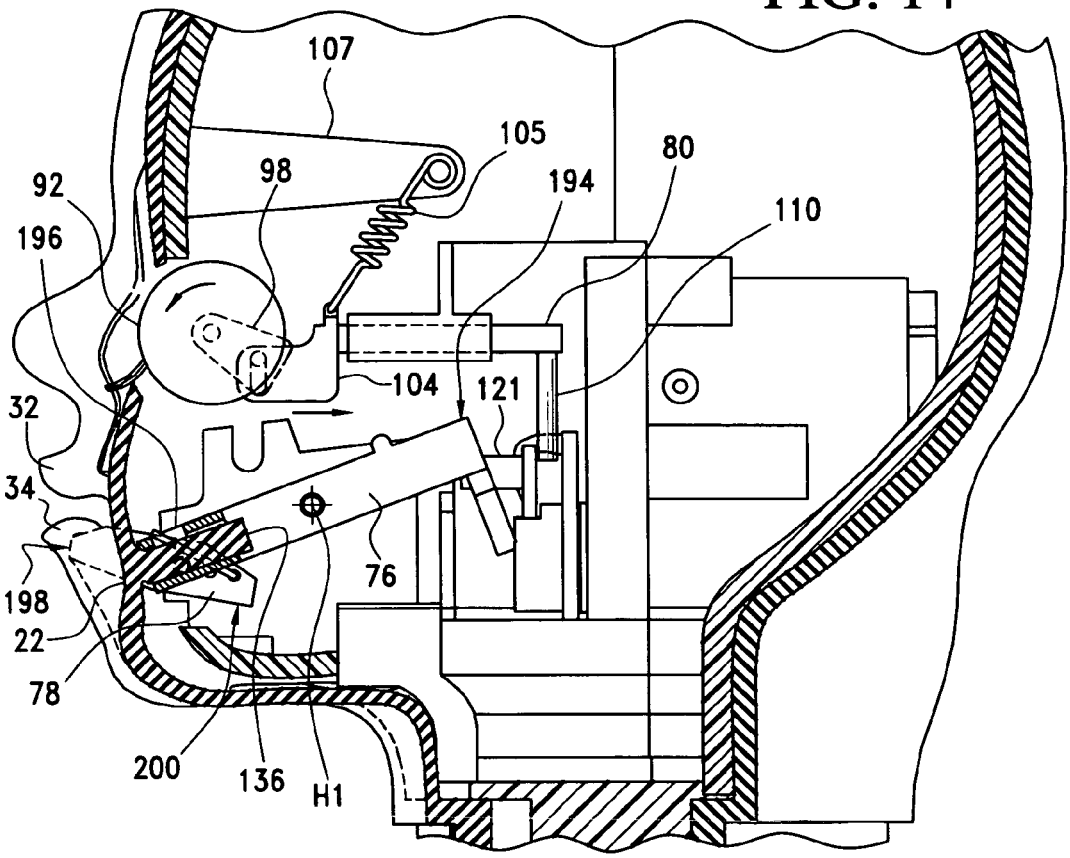
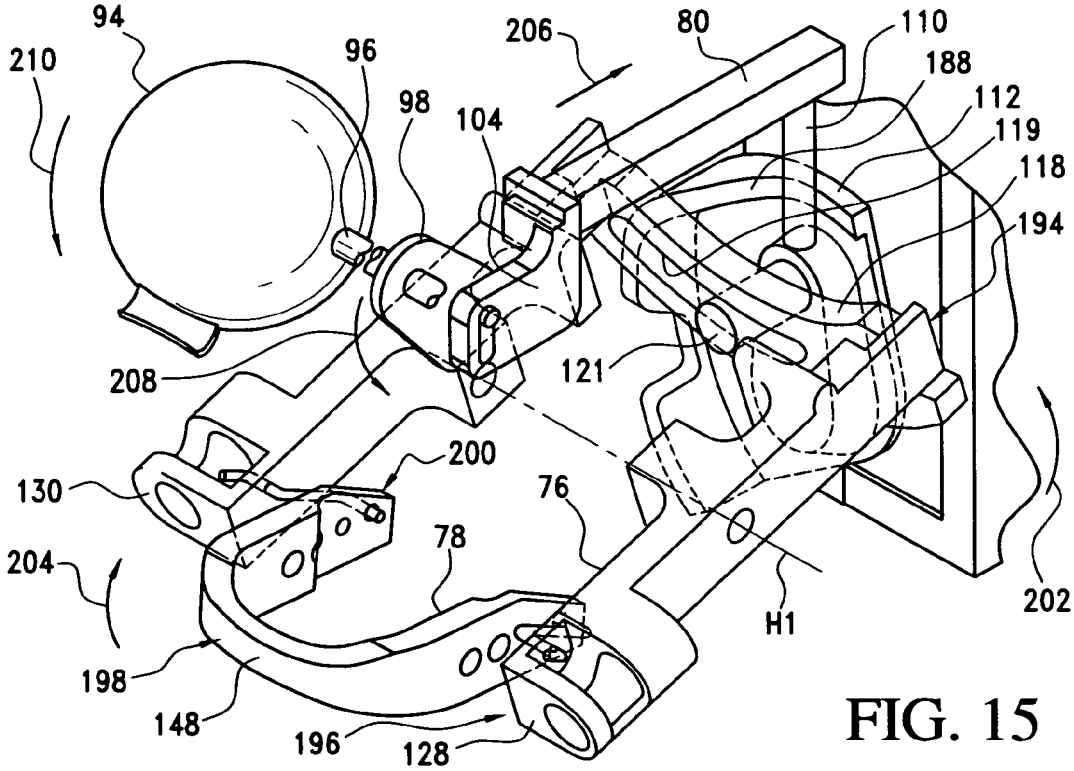
FIG. 15

EXPRESSION MECHANISM FOR A TOY, SUCH AS A DOLL, HAVING FIXED OR MOVEABLE EYES

CROSS-REFERENCE TO RELATED APPLICATIONS

The present application claims priority on prior U.S. Provisional Application Ser. No. 60/575,809, filed Jun. 2, 2004, which is hereby incorporated herein in its entirety by reference.

FIELD AND BACKGROUND OF THE INVENTION

The present invention is generally directed to toys, and more particularly to an expression mechanism for a toy, such as a doll, which has fixed or movable eyes.

In order to enhance playing enjoyment, use as an educational tool, or to stimulate child learning and development, the industry has provided various toys or toy figures that simulate reality. For instance, there are available varieties of dolls that simulate one or more human functions, such as tearing, crying, talking, smiling, frowning, etc.

Although dolls are currently available that simulate various facial expressions, they appear unnatural and less than realistic. For instance, many dolls, lack complete or insufficient coordination of movements between the mouth, cheeks, and/or the eyes. As a result, the expressions appear more mechanical and less humanistic. In addition, the conventional expression mechanisms are bulky, complicated and occupy spaces both in the head and body of the toy, thereby making manufacturing of the dolls expensive and complicated.

Examples of various expression devices are disclosed in U.S. Pat. Nos. 3,053,009; 3,444,645; 3,445,955; 3,841,020; 5,324,225; 5,376,038; 5,746,602; 5,902,169; 6,068,536; 6,149,490; 6,309,275 B1; 6,319,010 B1; 6,358,111 B1; 6,375,535 B1; 6,394,872 B1; 6,497,604 B2; 6,497,606 B2; 6,497,607 B1; 6,514,117 B1; 6,537,128 B1; 6,544,094 B1; 6,544,098 B1; 6,565,407 B1; U.S. Patent Application Publication Nos. 2001/0034180 A1; 2002/0061700 A1; 2002/0052163 A1; 2002/0061708 A1; 2002/0086607 A1; 2003/0099919 A1; 2002/0187722 A1; and Foreign Patent Documents Nos. Europe 0,528,092 A1; Europe 0,529,171 A1; Europe 0,534,032 A1 and Europe 0,549,840 A1.

In view of the drawbacks associated with conventional expression toys or toy figures, there is a need in the industry for an expression mechanism which allows a toy to simulate or mimic more natural and human-like expressions, is compact, and less complicated.

OBJECTS AND SUMMARY OF THE INVENTION

An object of the present invention is to provide an expression mechanism for a toy, such as a doll, which overcomes the drawbacks of the conventional devices.

A further object of the present invention is to provide an expression mechanism which allows a toy, such as a doll, to simulate or mimic more natural and human-like expressions, such as happy or smile, unhappy or frown, resting or neutral, etc.

A further object of the present invention is to provide an expression mechanism for a toy, such as a doll, which is simple and compact in design and assembly.

A further object of the present invention is to provide an expression mechanism for a toy, such as a doll, wherein a facial expression is simulated by combined, coordinated, and/or synchronized movements between the mouth, cheeks, and/or the eyes.

A further object of the present invention is to provide an expression mechanism for a toy, such as a doll, with fixed or movable eyes.

A further object of the present invention is to provide an expression mechanism for a toy which is controlled manually by a switch or the like device, including an on-off switch, an attitude switch, a shock switch, a shake switch, a pressure switch, a magnetic switch, or the like.

A further object of the present invention is to provide an expression mechanism for a toy which is controlled by a microprocessor or the like device. The microprocessor may be programmed to be activated automatically, or by a tactile input, such as pressing a switch, or a touch-activated contact switch, or an external signal, such as an audio input through a microphone, or an optical input through a photo sensor.

A further object of the present invention is to provide an expression mechanism for a toy wherein the motor for the expression mechanism is preferably controlled by a microprocessor or the like device that could be activated or deactivated by various means, such as an attitude switch, a shake switch, a shock switch, a pressure switch, a magnetic switch, a microphone for receiving an audible stimulus or signal, a photo sensor for receiving an optical signal, or various other types of mechanisms, actuators, switches or the like, may be provided to activate or deactivate the microprocessor to start or stop the expression mechanism. The microprocessor is preferably programmed to allow a doll to mimic various expressions in response to, or independently of, an external signal, such as an audio or optical signal, or a tactile or other similar stimulus. In addition to allowing the doll to mimic expressions, the microprocessor may also be programmed so that the doll makes sounds generally synchronously with the expressions to become an animated toy or doll. For instance, in the frown position, the doll may also make moaning or crying sounds. In this regard, although not shown, an appropriate audio unit may be provided.

A further object of the present invention is to provide an expression mechanism which allows a doll to mimic other expressions by switching, as needed, between the three preferred positions (smile, frown, and neutral), such as laughing, giggling, yawning, crying, etc. For example, to mimic laughing, the expression mechanism would cause the doll to audibly giggle and during this giggle audio its mouth would animate back and forth between the smile and the resting positions. In the same manner, to allow a doll to mimic crying, the expression mechanism would cause the doll to switch between neutral and frown positions. As before, in the crying mode, the doll's mouth would become animated as the expression mechanism switches back and forth between the neutral and frown positions.

A further object of the present invention is to provide an expression mechanism which may be controlled by a manually driven linkage. An example of a manually driven activation of the expression mechanism would include twisting or pivoting an arm of the doll.

A further object of the present invention is to provide an expression mechanism, wherein the activation of the expression mechanism, by the microprocessor, manually, or by a switch, causes turning of a cam which pivots the cheek lever that in turn pivots the lip lever, to assume a neutral, a smile, or a frown position. In the embodiment of the doll having movable eyes, the turning of the cam would also cause an eye slider linkage to translate back and forth to open or close the eyes.

A further object of the present invention is to provide a doll which has fixed eyes and is capable of mimicking expressions, with or without associated sounds, such as resting, smiling, frowning, giggling, laughing, crying, etc.

A further object of the present invention is to provide a doll which has movable eyes and is capable of mimicking expressions, with or without associated sounds, such as resting, smiling, frowning, giggling, laughing, crying etc.

A further object of the present invention is to provide a doll with movable eyes which mimics various expressions, wherein the opening or closing of the eyes is preferably controlled by the same motor that controls the expression mechanism.

In summary, the main object of the present invention is to provide an expression mechanism for a toy, such as a doll, with fixed or movable eyes, which is controlled mechanically by a switch or the like device, automatically by a microprocessor or the like device, or manually by a linkage or the like mechanism. The opening or closing of the eyes is preferably controlled by the same motor that controls the expression mechanism. Preferably, the expression mechanism causes the toy to mimic expressions, such as resting, smiling, frowning, and/or the like. The expressions are with or without the associated generally synchronous sounds. (The term "toy" as used in the present disclosure, includes, but not limited to, toys, toy figures, figures, and the like.)

At least one of the above objects is met, in part, by the present invention, which in accordance with one aspect includes an expression mechanism for a toy having a lower lip, a cheek and an eye, comprising a first member for engaging the lower lip of a toy, a second member in pivotable engagement with the first member for engaging a cheek of the toy, a third member for opening or closing the eye of the toy, and a motor for actuating one of the first and second members to cause the toy to simulate a facial expression.

In accordance with another aspect of the present invention, an expression mechanism for a toy having a lower lip, a cheek and an eye, includes a support frame, a lip lever pivotally connected to the support frame for engaging the lower lip of a toy, a cheek lever pivotally connected to the support frame for engaging a cheek of the toy, an eye linkage for opening or closing the eye of the toy, and a motor for actuating one of the lip and cheek levers to cause the toy to simulate a facial expression. The lip and cheek levers are interconnected in a manner that when the cheek lever pivots in one direction, the lip lever pivots in a generally opposite direction.

In accordance with another aspect of the present invention, an expression mechanism for a toy having a lower lip and a cheek, includes a lip lever for engaging the lower lip of a toy, a cheek lever for engaging a cheek of the toy, and a motor for actuating one of the lip and cheek levers to cause the toy to simulate a facial expression. The lip and cheek levers are interconnected in a manner to move in generally opposite directions.

In accordance with another aspect of the present invention, a toy for simulating a facial expression having upper and lower lips, left and right cheeks and eyes, includes a support inside the toy, a lip lever pivotally connected to the support and including front and rear end portions, a cheek lever pivotally connected to the support and including front and rear end portions, an eye linkage for opening or closing of the eyes, and a motor for actuating one of the lip and cheek levers. The front end portion of the lip lever is in operable engagement with the lower lip of the toy. The cheek lever is in operable engagement with the left and right cheeks of the toy, and the rear end portion of the lip lever is in pivotable engagement with the front end portion of the cheek lever. The lip and cheek levers are interconnected in a manner that when the front end of the cheek lever moves upwardly, the front end of the lip lever moves downwardly.

In accordance with another aspect of the present invention, a method of causing a toy having a lower lip, a cheek and an eye, to simulate a facial expression, includes a) providing an expression mechanism, including a first member for engaging the lower lip of a toy, a second member in pivotable engagement with the first member for engaging a cheek of the toy, a third member for opening or closing the eye of the toy, and a motor for actuating one of the first and second members to cause the toy to simulate a facial expression; and b) actuating one of the first and second members to move the cheek and the lower lip to cause the toy to simulate a facial expression.

In accordance with another aspect of the present invention, an interactive play method includes a) providing a toy comprising an expression mechanism, b) actuating the toy to an on position wherein the toy assumes a coo or baby-talk mode, c) providing a first tactile stimulus to cause the toy to simulate at least one expression selected from the group consisting of smile, laugh, giggle, frown, and a combination thereof, d) placing the toy in a lying position to cause the toy to assume a yawn mode, e) providing a second tactile stimulus to cause the toy to assume a sleep mode, and f) lifting the toy upright to cause the toy to assume a wake-up mode.

In accordance with another aspect of the present invention, an interactive play method includes a) providing a toy comprising an expression mechanism, b) actuating the toy to an on position wherein the toy assumes a coo or baby-talk mode, and c) providing a first external stimulus to cause the toy to simulate at least one expression selected from the group consisting of smile, laugh, giggle, frown, and a combination thereof.

BRIEF DESCRIPTION OF THE DRAWINGS

One of the above and other objects, novel features and advantages of the present invention will become apparent from the following detailed description of the preferred embodiment(s) of the invention, as illustrated in the drawings, in which:

FIG. 11 illustrates a frown expression simulated by the doll;

FIG. 12 illustrates a neutral or resting expression simulated by the doll;

FIG. 13 illustrated a smile expression simulated by the doll;

FIG. 14 is a partial enlarged sectional view taken along line 14-14 of FIG. 11;

FIG. 15 illustrates the relationship of lip and cheek levers, the eye slider linkage, and the eye cam, in the frown expression shown in FIG. 11;

It is noted herewith that the same reference numerals have been used in the present disclosure to designate the same or similar components, or features.

DETAILED DESCRIPTION OF THE PREFERRED EMBODIMENT(S) OF THE INVENTION

Figure 1:
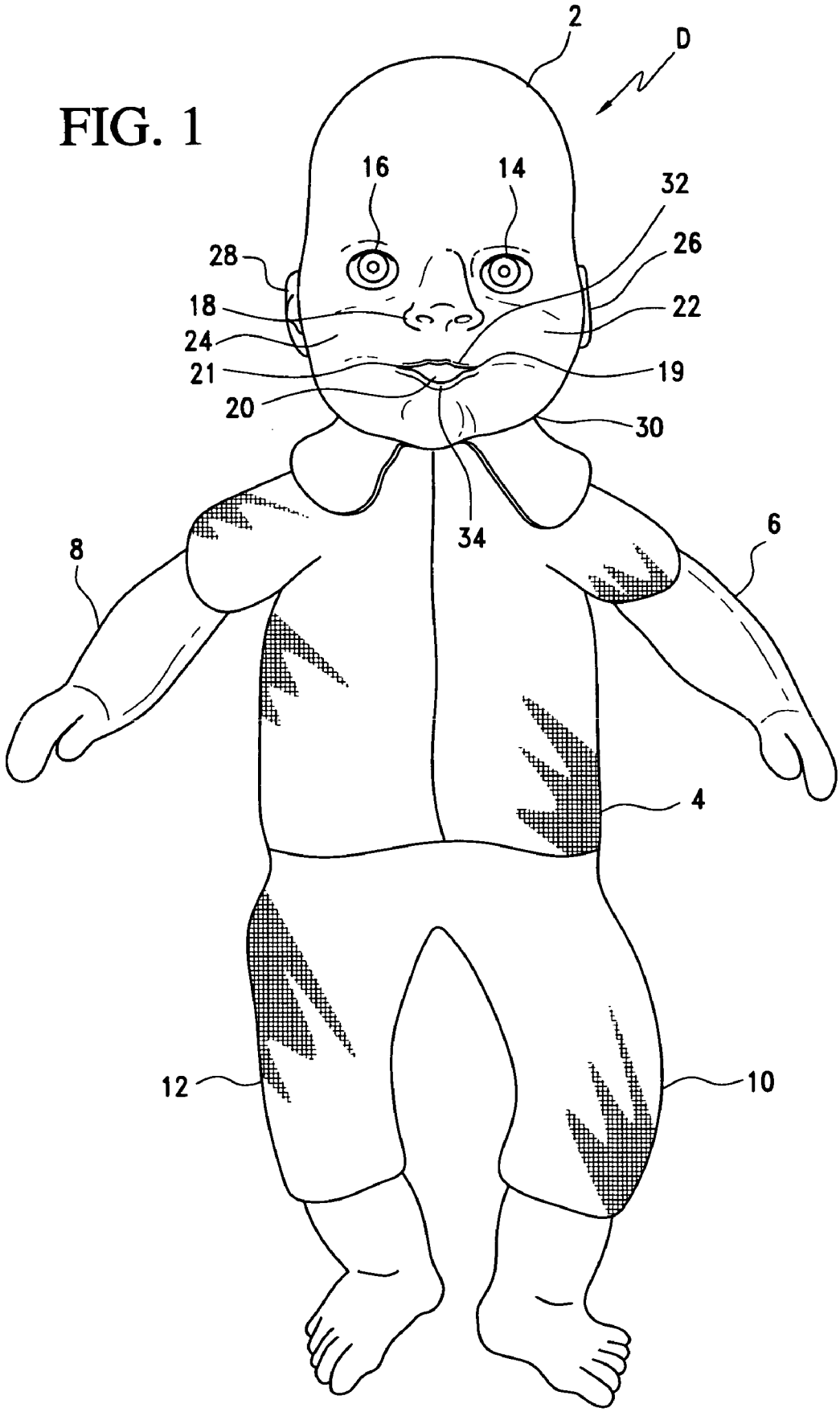
FIG. 1 is a front perspective view of a toy doll in accordance with the present invention.

FIG. 1 illustrates a toy or toy figure, preferably in the form of a doll D, with a head 2, body 4 with left and right arms 6 and 8, and left and right legs 10 and 12. The head 2 includes left and right eyes 14 and 16, a nose 18, a mouth 20, left and right cheeks 22 and 24, and left and right ears 26 and 28. The head 2 and body 4 are connected by a neck 30. The mouth 20 includes upper and lower lips 32 and 34, and left and right corners 19 and 21.

Figure 2:
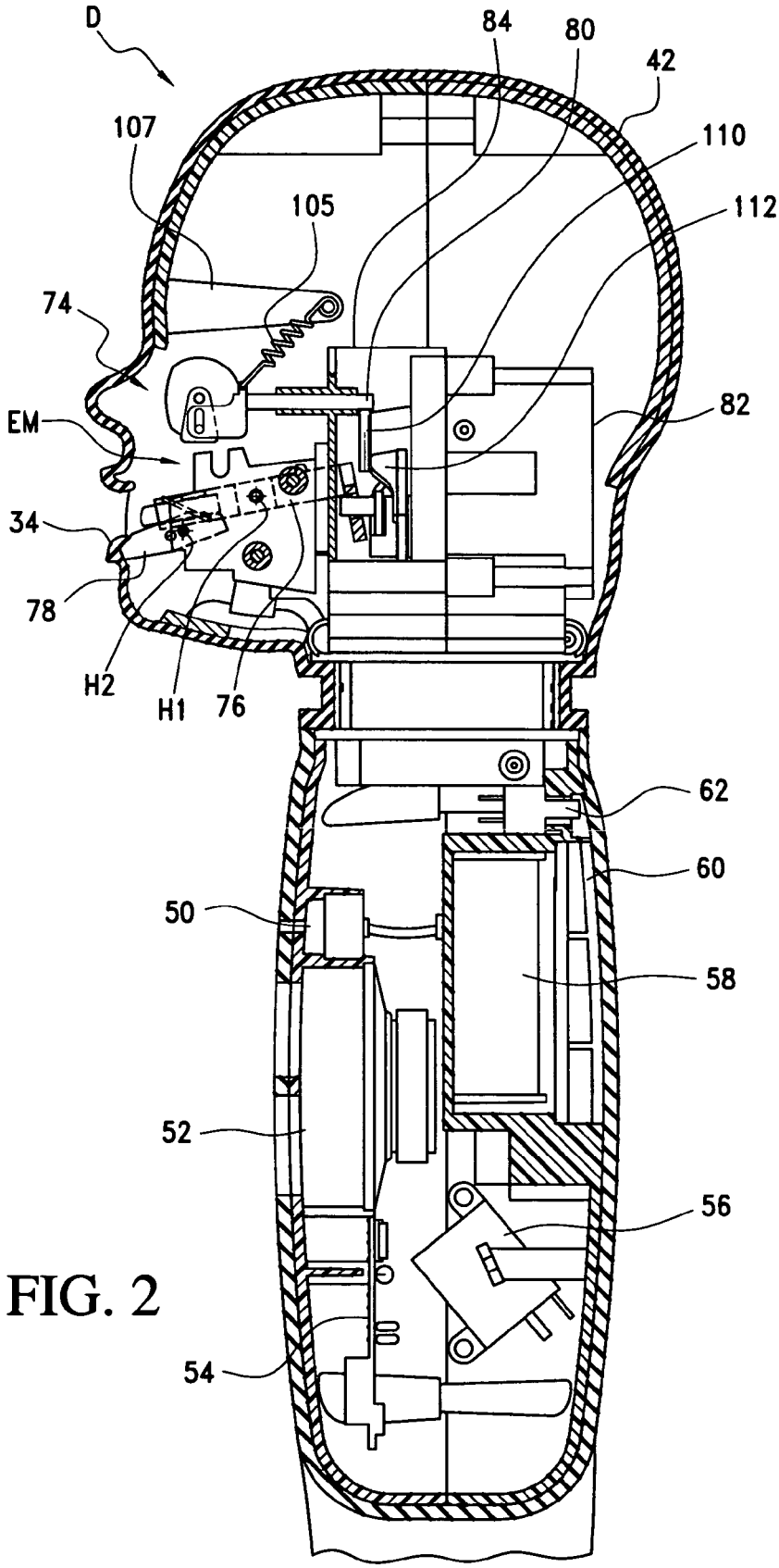
FIG. 2 is a partial side cross-sectional view of the doll shown in FIG. 1.
Figure 4:
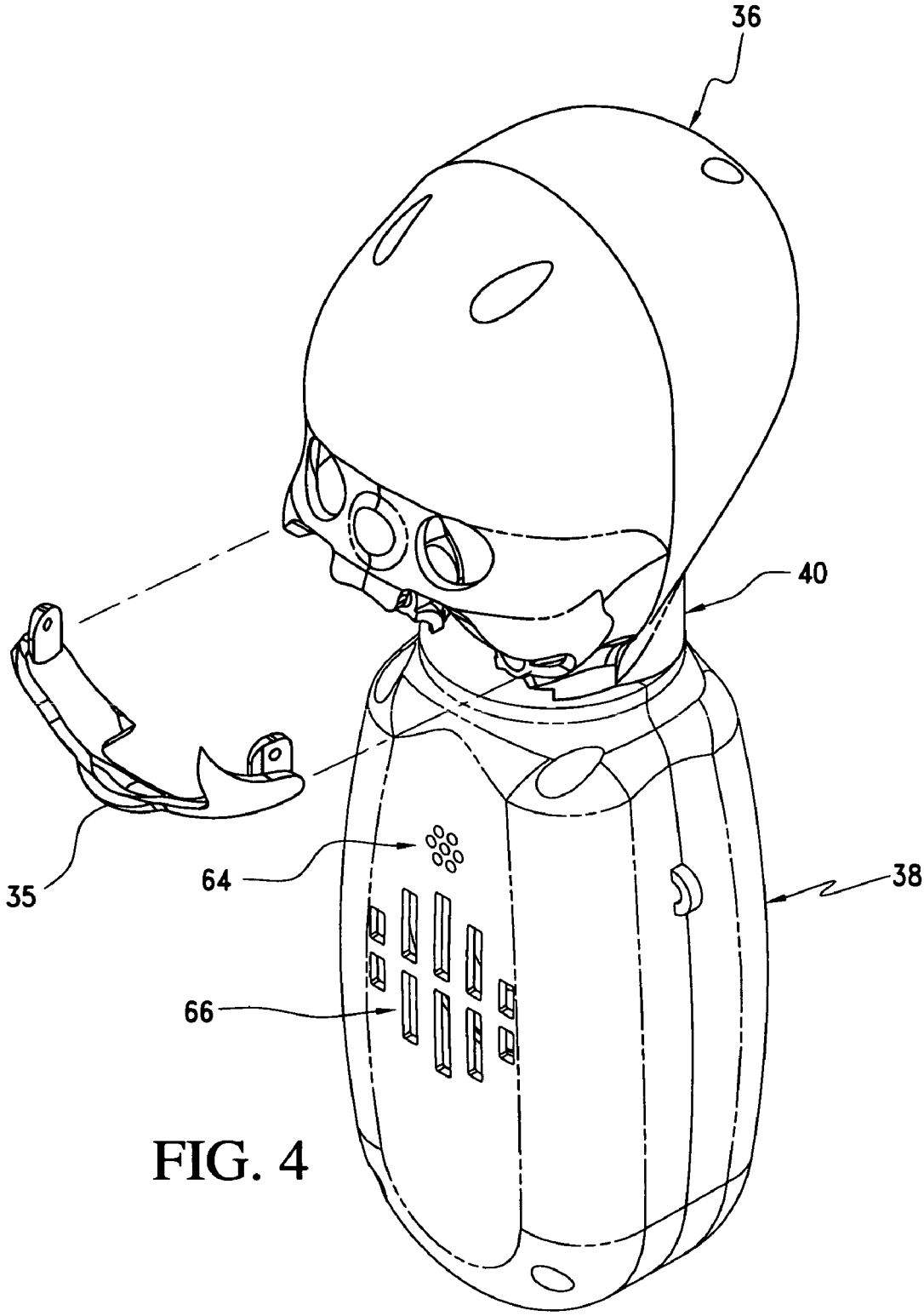
FIG. 4 is a perspective view of the head and body assemblies of the doll shown in FIG. 1.

As best shown in FIG. 4, the doll D includes an internal head assembly 36 and a body assembly 38 connected by a neck adapter 40. Preferably, the internal head and body assemblies 36 and 38 and the neck adapter 40, are made from a rigid plastic or the like conventional material, which is then covered by a flexible material 42 that simulates natural skin (FIG. 2). A chin guard 35 is provided to protect the expression mechanism EM (described below) from damage due, for example, to the doll D coming in accidental contact with a hard surface or the like.

Figure 3:
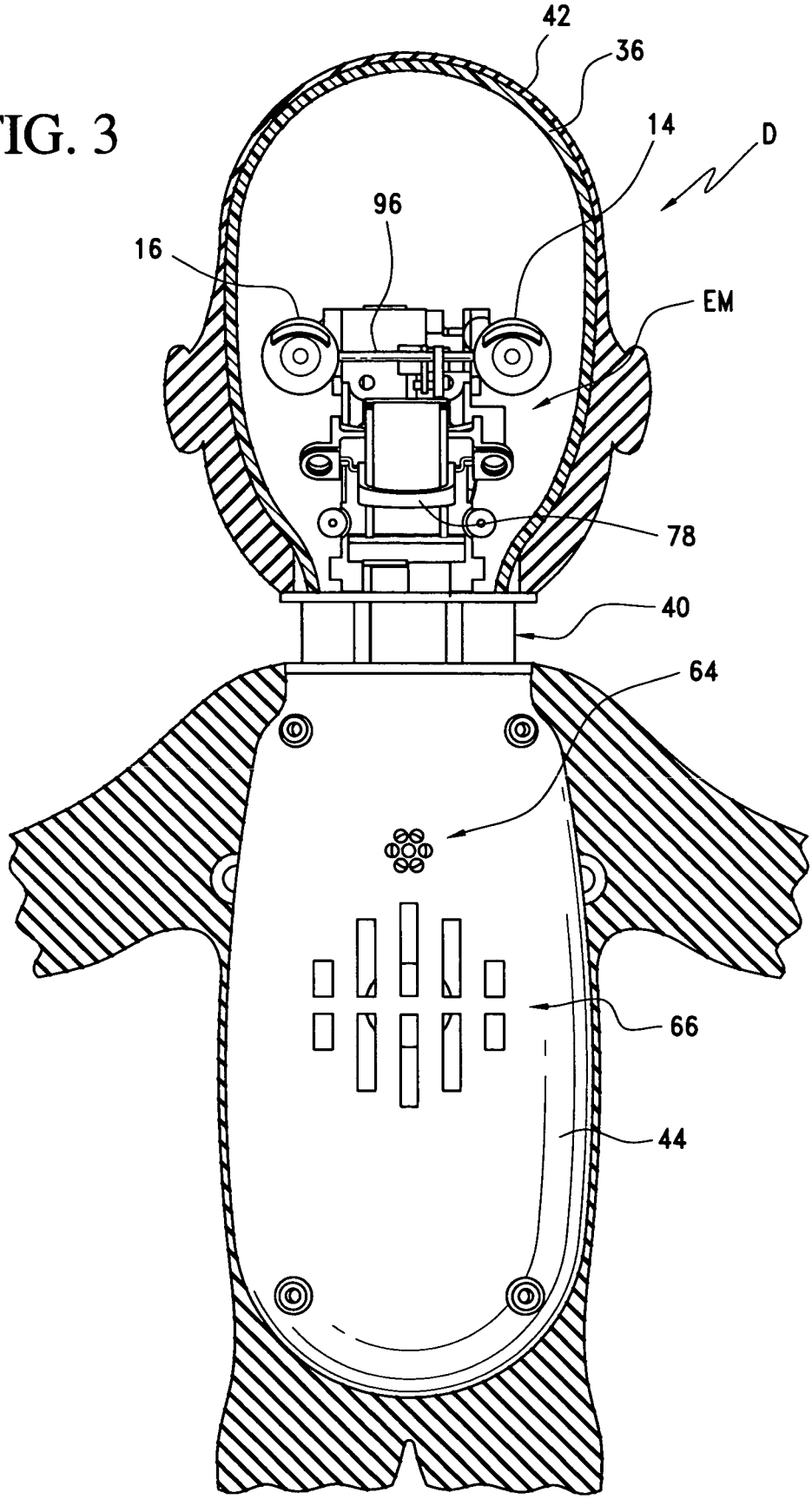
FIG. 3 is a partial front cross-sectional view of the doll shown in FIG. 1, shown without the chin guard.
Figure 5:
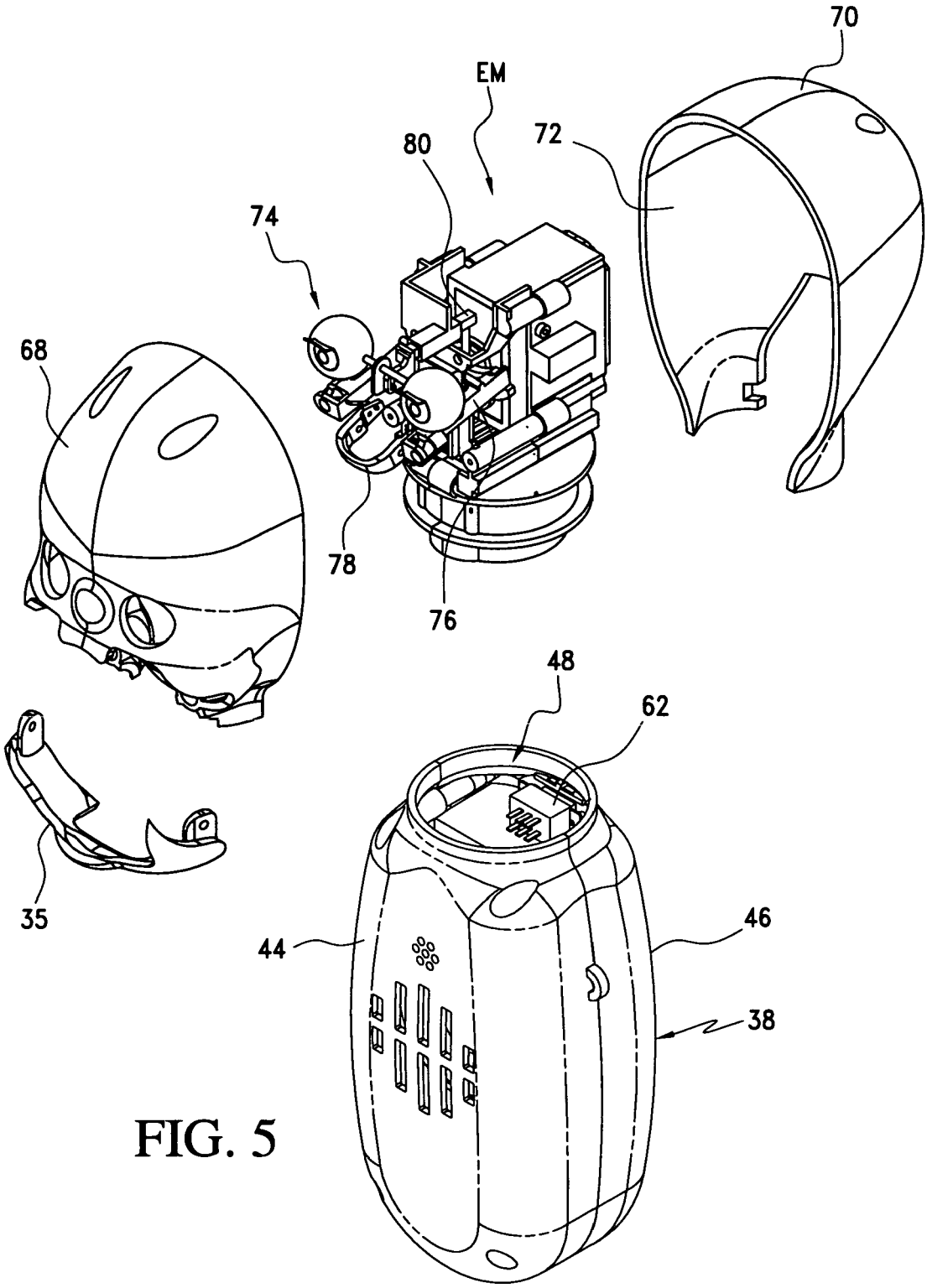
FIG. 5 is a partially exploded view of the head and body assemblies shown in FIG. 4.

As best shown in FIG. 5, the body assembly 38 includes front and rear body housings 44 and 46 connected together in a conventional manner to define an internal chamber 48. As best shown in FIG. 2, the internal chamber 48 is preferably provided with a microphone assembly 50, a speaker assembly 52, a circuit board 54, an attitude or the like switch 56, a battery compartment 58 with a cover 60, and an ON-OFF switch 62. (It is noted herewith that a different set of components may be provided to obtain different functionalities for the doll, as desired.) As best shown in FIGS. 3-4, the front body housing 44 is provided with microphone and speaker holes 64 and 66, respectively, for communication with the microphone and speaker assemblies 50 and 52.

As further shown in FIG. 5, the head assembly 36 includes front and rear head housings 68 and 70 connected together in a conventional manner to define an internal recess 72 for accommodating therein the expression mechanism EM.

Figure 6:
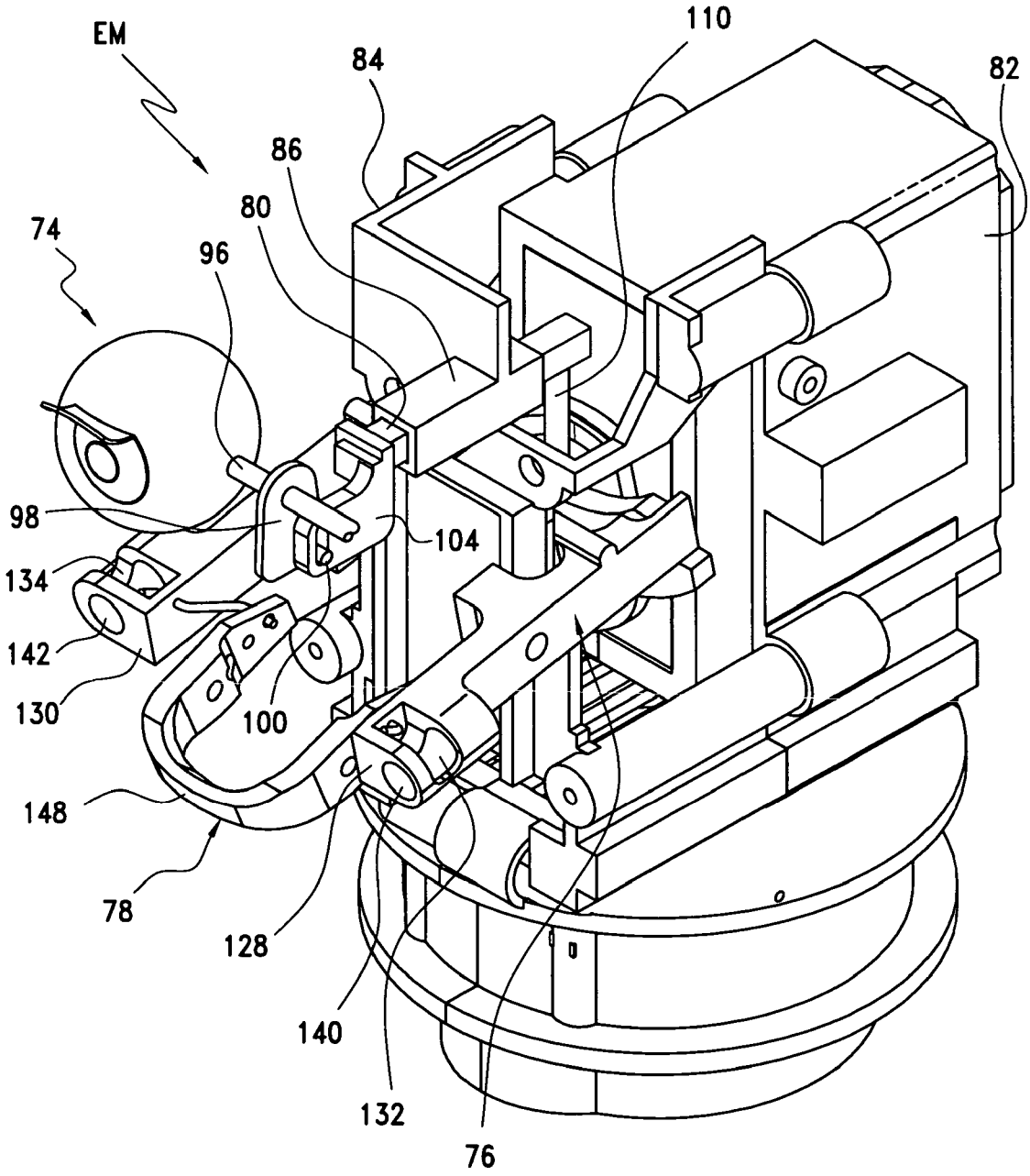
FIG. 6 is a perspective view of the expression mechanism of FIG. 5, shown without the left eye for clarity.
Figures 7, 8:
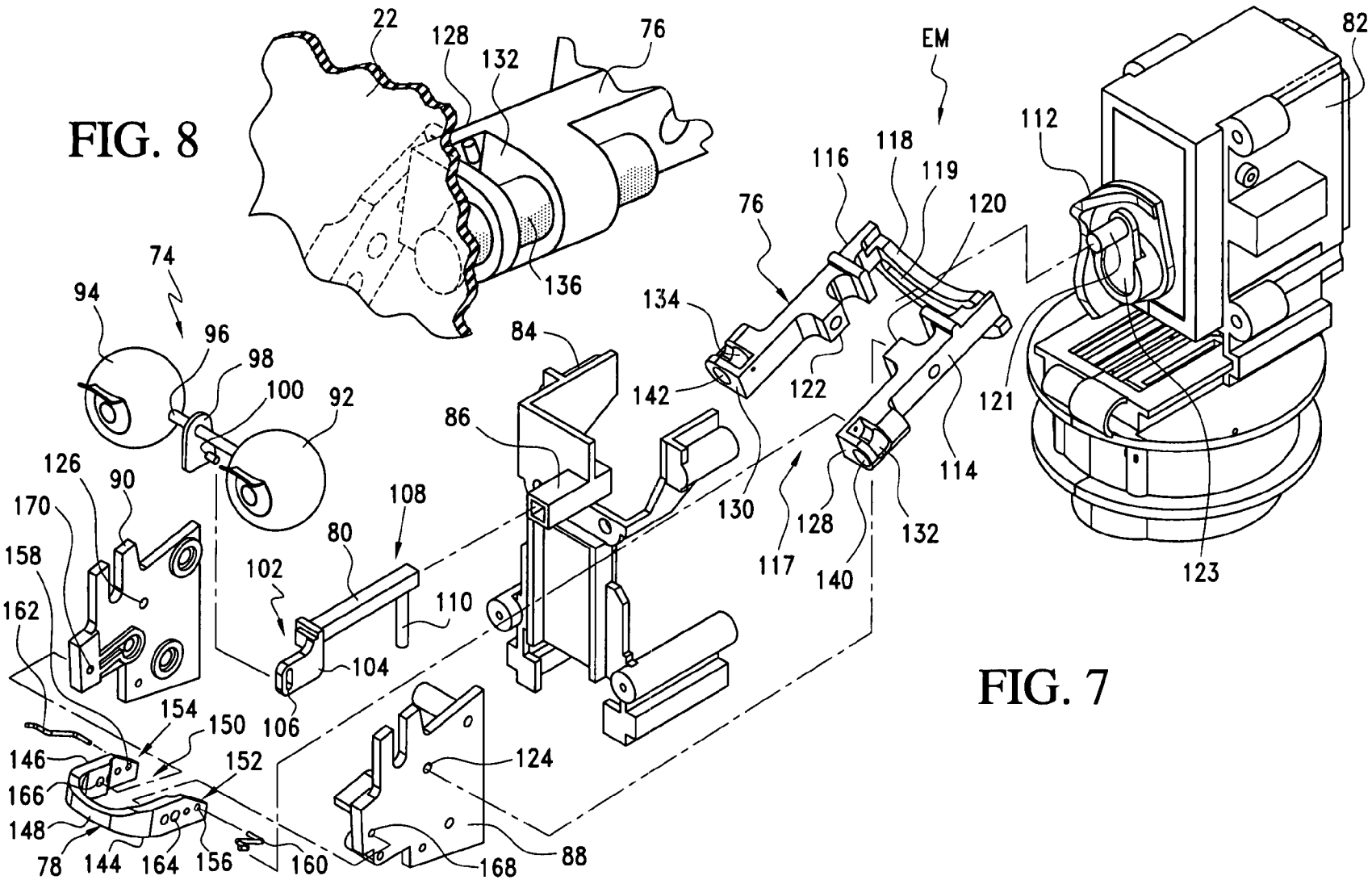
FIG. 7 is an exploded view of the expression mechanism of FIG. 5.
FIG. 8 illustrates the connection between the left cheek and the cheek lever, the connection of right cheek being similar thereto.

Referring to FIGS. 6-7, the expression mechanism EM preferably includes an eye assembly 74, a cheek lever 76, a lip lever 78, pivotally connected to the cheek lever 76, and an eye slider linkage 80. A motor, preferably a servo motor (not shown) is positioned in a housing 82. A frame 84 is positioned in front of the housing 82 for supporting the eye slider linkage 80 through a conduit 86 thereof. The cheek lever 76 is pivotally mounted to the left and right support plates 88 and 90, as described below. (It is noted herewith that it is within the scope of the present invention to use or operate the expression mechanism EM with or without the operation of the eyes.)

The eye assembly 74 includes left and right eyeballs 92 and 94 interconnected by a shaft 96. A toggle member 98 including a pin 100 is mounted on the shaft 96.

Figure 9:
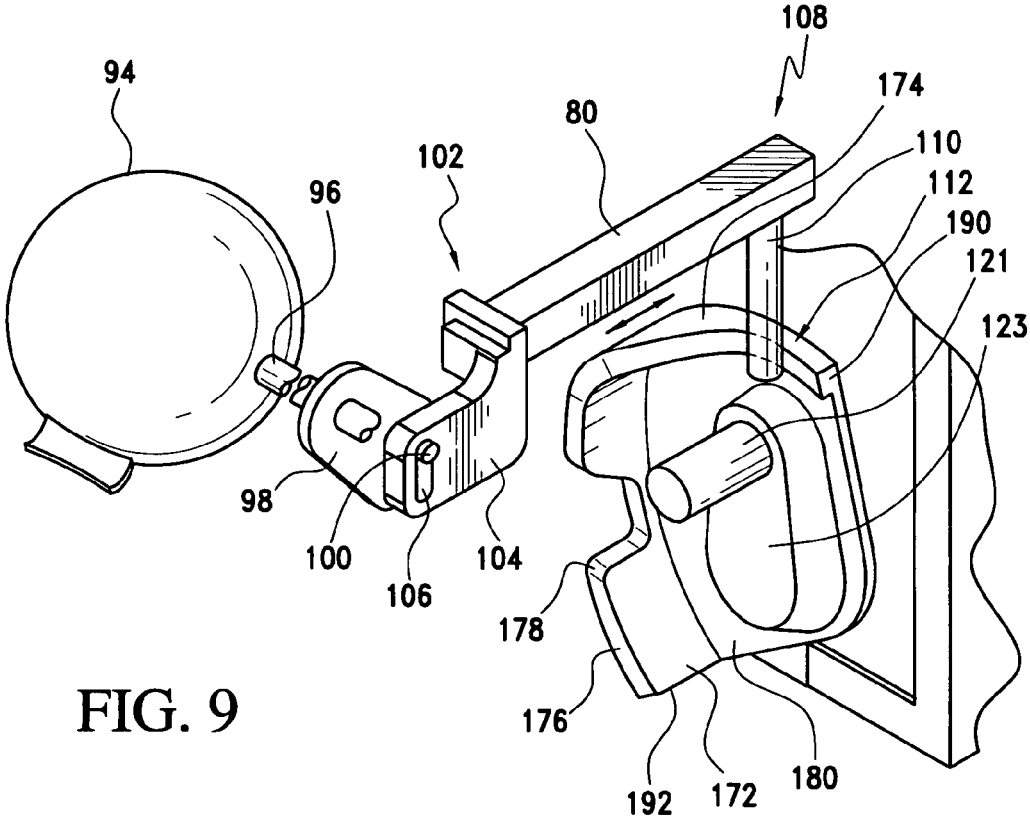
FIG. 9 illustrates the relationship between the eye slider linkage and the eye cam.

As best shown in FIGS. 7 and 9, the eye slider linkage 80 includes at its front end 102 an actuator plate 104 with a generally vertically oriented slot 106 for receiving the pin 100. At the rear end 108 of the eye slider linkage 80 is provided an arm 110 that engages an eye cam 112 which is rotated by the motor, as described below. As best shown in, for example, FIG. 14, a spring 105, mounted between a bracket 107 and the actuator plate 104, keeps the eye slider linkage 80 pulled towards the eye cam 112.

The cheek lever 76 is a generally U-shaped member including left and right laterally disposed arms 114 and 116 interconnected by a rear arm 118 and defining a front opening 117. The arms 114 and 116 include corresponding internal tabs 120 and 122, respectively, for pivotally connecting the cheek lever 76 at the left and right holes 124 and 126 in the left and right support plates 88 and 90, by conventional fasteners (not shown) in a known manner. The front ends 128 and 130 of the left and right arms 114 and 116, include recesses 132 and 134, respectively, for receiving the corresponding cheek tabs 136 and 138 via holes 140 and 142 (only the left cheek tab 136 is shown in FIG. 8).

The lip lever 178 is also preferably generally U-shaped member with left and right arms 144 and 146 connected by a front arm 148 and defining a rear opening 150. The rear ends 152 and 154 of the left and right arm 144 and 146, include rear holes 156 and 158, respectively, for pivotally connecting to the front ends 128 and 130 of the cheek lever 76, by pins 160 and 162, in a known manner. The left and right arms 144 and 146 further include front holes 164 and 166 for pivotally connecting to the left and right mouths support plates 88 and 90 at the holes 168 and 170 thereof by using conventional fasteners, in a known manner.

Preferably, the width of the rear opening 150 in the lip lever 78 is smaller than the front opening 117 in the cheek lever 76, such that the lip lever 78 is positioned inwardly into the cheek lever 76.

A preferably arcuate cam slot 119 is provided in the rear arm 118 of the cheek lever 76 for slidably receiving an output shaft 121 which is rotatably connected to the motor by an output plate 123.

As shown, for example, in FIGS. 2 and 14, the front arm 148 of the lip lever 78 engages the inside of the lower lip 34 to move it upwardly or downwardly, as described below.

Figure 10:
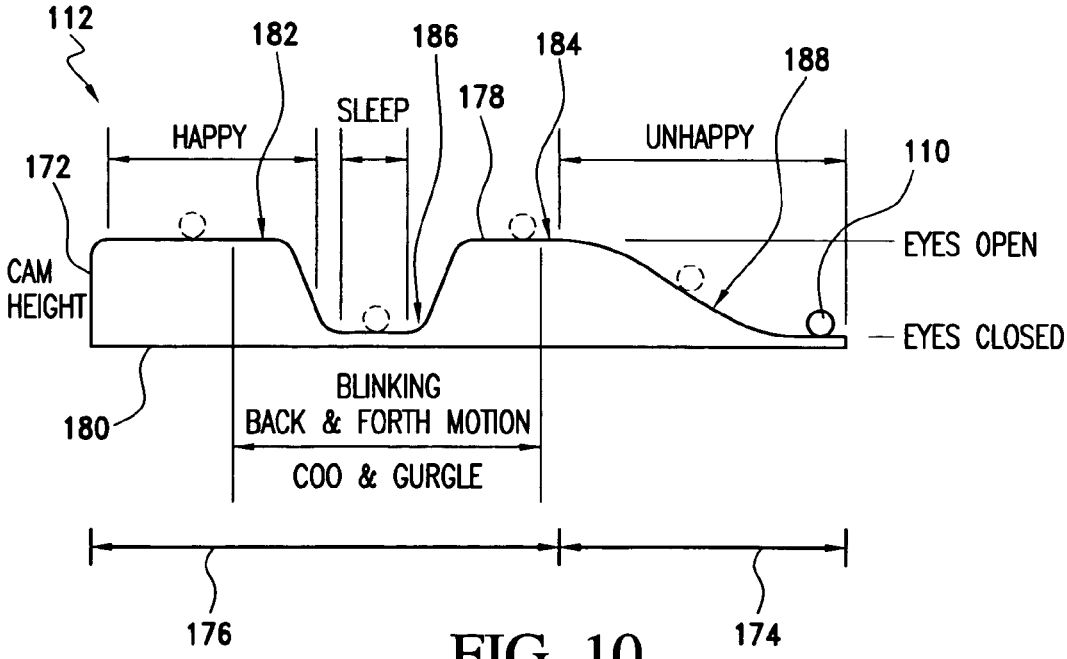
FIG. 10 is a graphical illustration of the relationship between the eye cam surface and the arm of the eye slider linkage resulting in opening or closing of the eyes and the various expressions simulated by the doll.

As best shown in FIGS. 9-10, the eye cam 112 includes a cam wall 172 with sections 174 and 176 extending generally at a right angle to one another. A cam surface 178 spans across the wall sections 174 and 176 and engages the arm 110 of the eye slider linkage 80. As graphically illustrated in FIG. 10, the height of the cam surface 178 from the base 180 varies so as to provide preferably two peaks 182 and 184, a valley 186, and a slope 188. As described below, as the arm 110 slides over different sections of the cam surface 178, the eye slider linkage 80 translates back and forth in the conduit 86, thereby pivoting the left and right eyeballs 92 and 94 to simulate opening or closing of the eyes 14 and 16.

Figure 16:
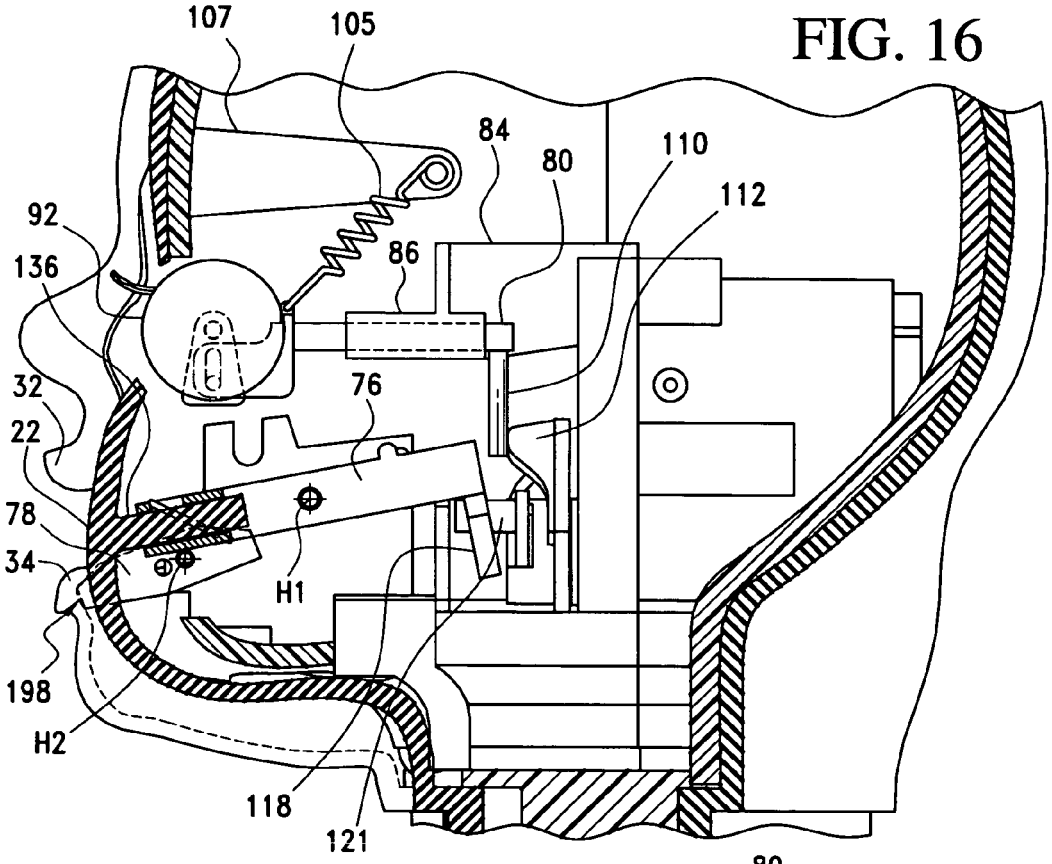
FIG. 16 is a partial enlarged sectional view taken along line 16-16 of FIG. 12.

From the above-described arrangement, one would appreciate that as the motor rotates, the output shaft 121 would cause the cheek lever 76 to pivot or see-saw about a horizontal axis $H_1$ (see FIGS. 2, 14-15 and 18, for example). Since the lip lever 78 is pivotally connected to the cheek lever 76, pivoting of the cheek lever 76 would cause the lip lever 78 to pivot about a horizontal axis $H_2$ up or down (FIG. 16). A rotation of the motor would also cause the eye cam 112 to rotate thereby causing the eye slider linkage 80 to translate back and forth depending on the position of the arm 110 relative to the cam surface 178. In this regard, it is noted herewith that since the motor is preferably a servo motor, it can be programmed to rotate, for example, just between the angular positions corresponding to the points slightly before the ends 190 and 192 of the cam 112 (FIG. 9).

Use and Operation

Figure 17:
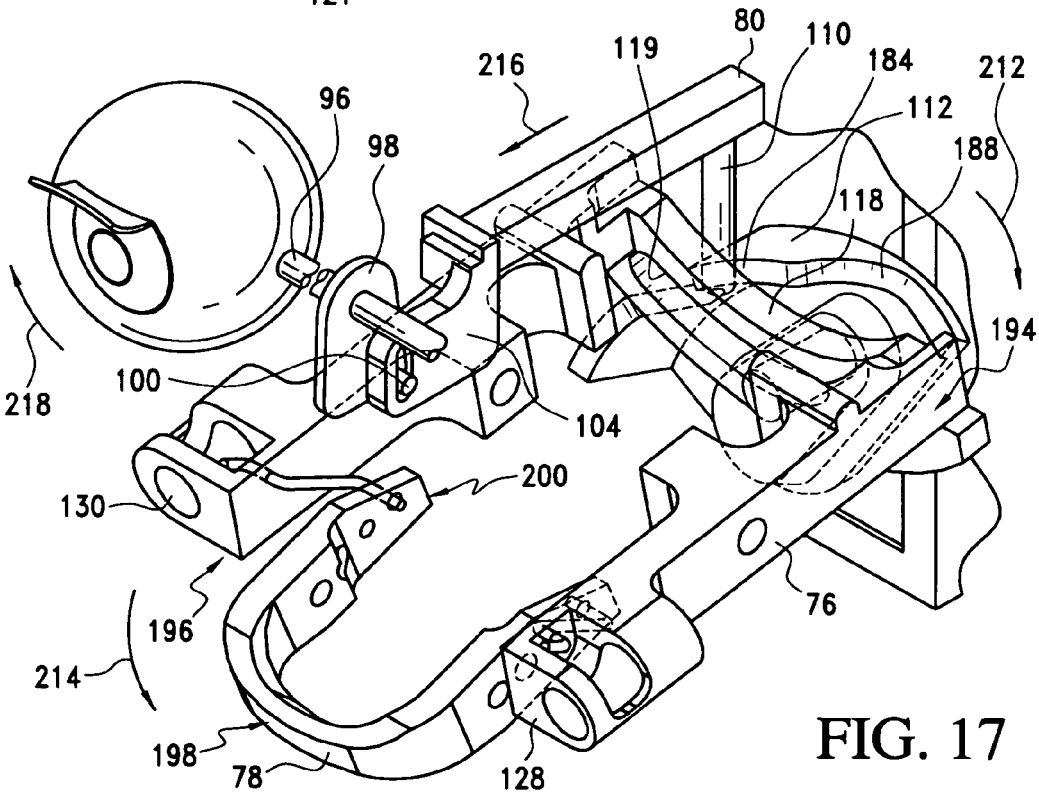
FIG. 17 illustrates the relationship of lip and cheek levers, the eye slider linkage, and the eye cam, in the neutral expression shown in FIG. 12.
Figure 18:
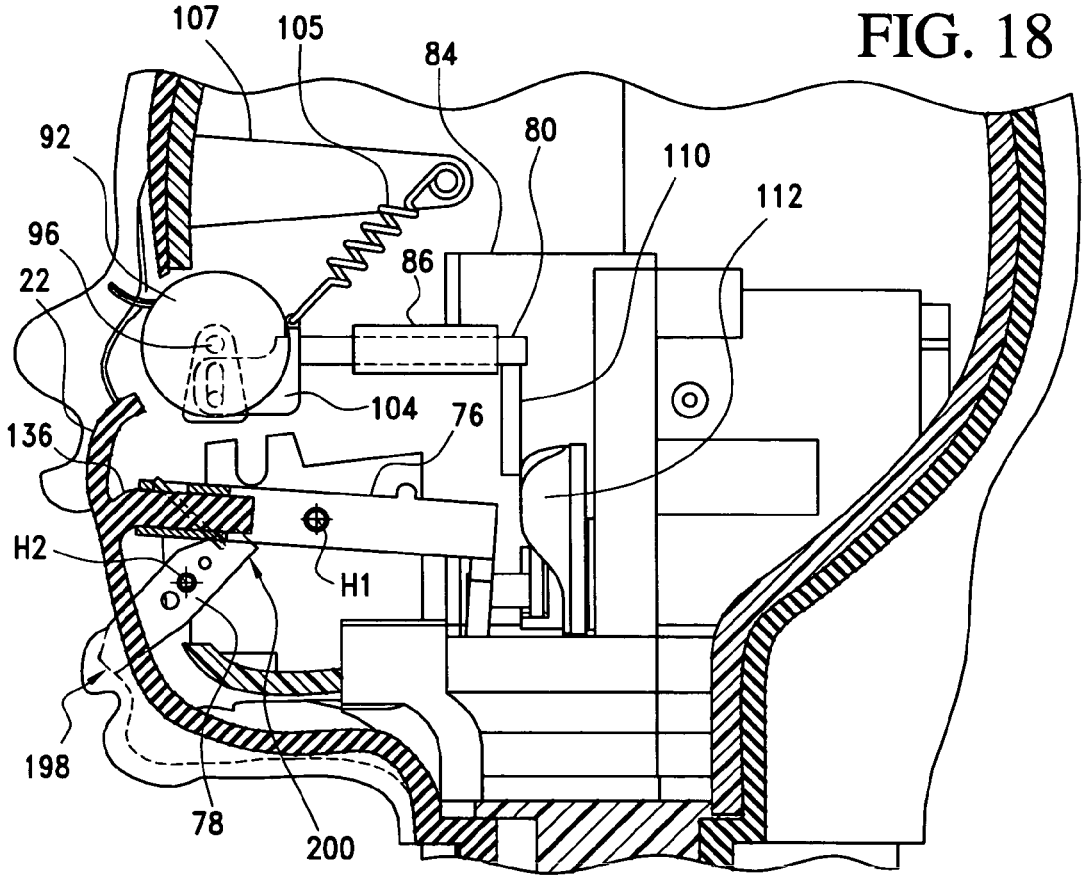
FIG. 18 is a partial enlarged sectional view taken along line 18-18 of FIG. 13.
Figure 19:
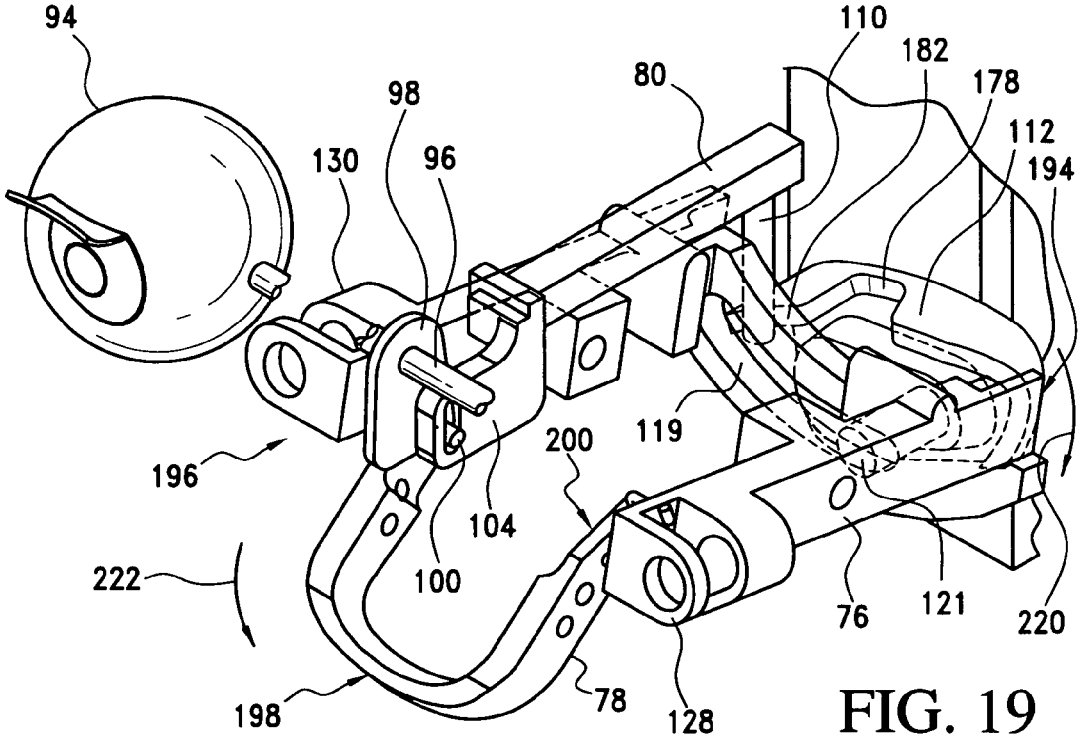
FIG. 19 illustrates the relationship of lip and cheek levers, the eye slider linkage, and the eye cam, in the smile expression shown in FIG. 13.

The basic operation of the expression mechanism EM of the present invention will now be described by referring to FIGS. 11-19, wherein FIGS. 11 and 14-15 illustrate simulation of an unhappy or frown position, FIGS. 12 and 16-17 illustrate a neutral position, and FIGS. 13 and 18-19 illustrate a happy or smile position, for the doll D. In the following description, the doll D is initially presumed to be in a neutral position shown in FIGS. 12 and 16-17, for a better understanding of the operation.

In order to simulate a frown or unhappy expression, the motor is rotated in a counterclockwise direction, such that the output shaft 121 slides in the slot 119 to pivot the rear arm 118 of the cheek lever 76 upwardly about the horizontal axis $H_1$ (FIG. 14). As the rear end 194 of the cheek lever 76 pivots upwardly (arrow 202 in FIG. 15), the front end 196 thereof pivots downwardly causing the front end 198 of the lip lever 78 to pivot upwardly (arrow 204 in FIG. 15) and pulling the rear end 200 thereof downwardly. Since the front end 198 of the lip lever 78 is in firm engagement with the central potion of the lower lip 34, this action would cause the lower lip 34 to move upwardly in a manner that the left and right corners 19 and 21 of the mouth 20 would drop down, while the upper lip 32 assumes a somewhat convex shape (FIG. 11). As the front end 196 of the cheek lever 76 moves downwardly, the left and right cheeks 22 and 24 will also be pulled down by the front ends 128 and 130 thereof. Further, as the motor rotates, the eye cam 112 would rotate such that the arm 110 slides down the slope 188 thereby pulling the slider linkage 80 towards the rear (arrow 206 in FIG. 15). The rearward slide of the linkage 80 would cause the actuator 104 to move rearwardly, thereby pivoting the eye actuator toggle 98 in a counterclockwise direction (arrow 208 in FIG. 15) which would rotate the eyeball 94 also in a counterclockwise direction to close the eye (arrow 210 in FIG. 15). These actions would cause the doll D to assume or simulate an unhappy or frown position shown in FIG. 11.

In order for the doll D to switch back to the initial neutral position (FIG. 12) from the frown position (FIG. 11), the motor would be rotated in an opposite (clockwise) direction in a manner that the rear end 194 of the cheek lever 76 pivots downwardly (arrow 212 in FIG. 17) such that the front end 196 thereof pulls up the rear end 200 of the lip lever 78. Generally, simultaneously, the front end 198 of the lip lever 78 pivots downwardly (arrow 214 in FIG. 17) allowing the central portion of the lower lip 34 to drop down and the corners 19 and 21 of the mouth 20 to move upwardly. In this position, the upper lip 32 would assume a somewhat straight position. Also, as the front end 196 of the cheek lever 76 moves upwardly, the left and right cheeks 22 and 24 will also move to a neutral position. As indicated in FIG. 10, in the neutral position shown in FIG. 12, the arm 110 of the linkage 80 would slide from the slope 188 to the peak 184 of the cam surface 178, causing the linkage 80 to move to the left (arrow 216 in FIG. 17) thereby opening the eyes (arrow 218 in FIG. 17).

In order for the doll D to assume or simulate a happy or smile position shown in FIG. 13, the motor is rotated in a clockwise direction such that the rear end 194 of the cheek lever 76 moves downwardly (arrow 220 in FIG. 19) causing the front end 196 thereof to move upwardly. This would cause the rear end 200 of the lip lever 78 to move upwardly, while the front end 198 thereof pivots downwardly bringing the central portion of the lower lip 34 down (arrow 222 in FIG. 19). As the front end 196 of the cheek lever 76 moves upwardly, the front ends 128 and 130 thereof would pull the left and right cheeks 22 and 24 upwardly. These actions would cause the corners 19 and 21 of the mouth 20 to move slightly upwardly such that the upper lip 32 assumes a somewhat concave configuration. It is noted that in the smile position, the arm 110 engages the peak 182 of the cam surface 178, thereby keeping the eyes open.

In accordance with the present invention, the general overall operation of the doll D with the expression mechanism EM will now be described.

Figure 20:
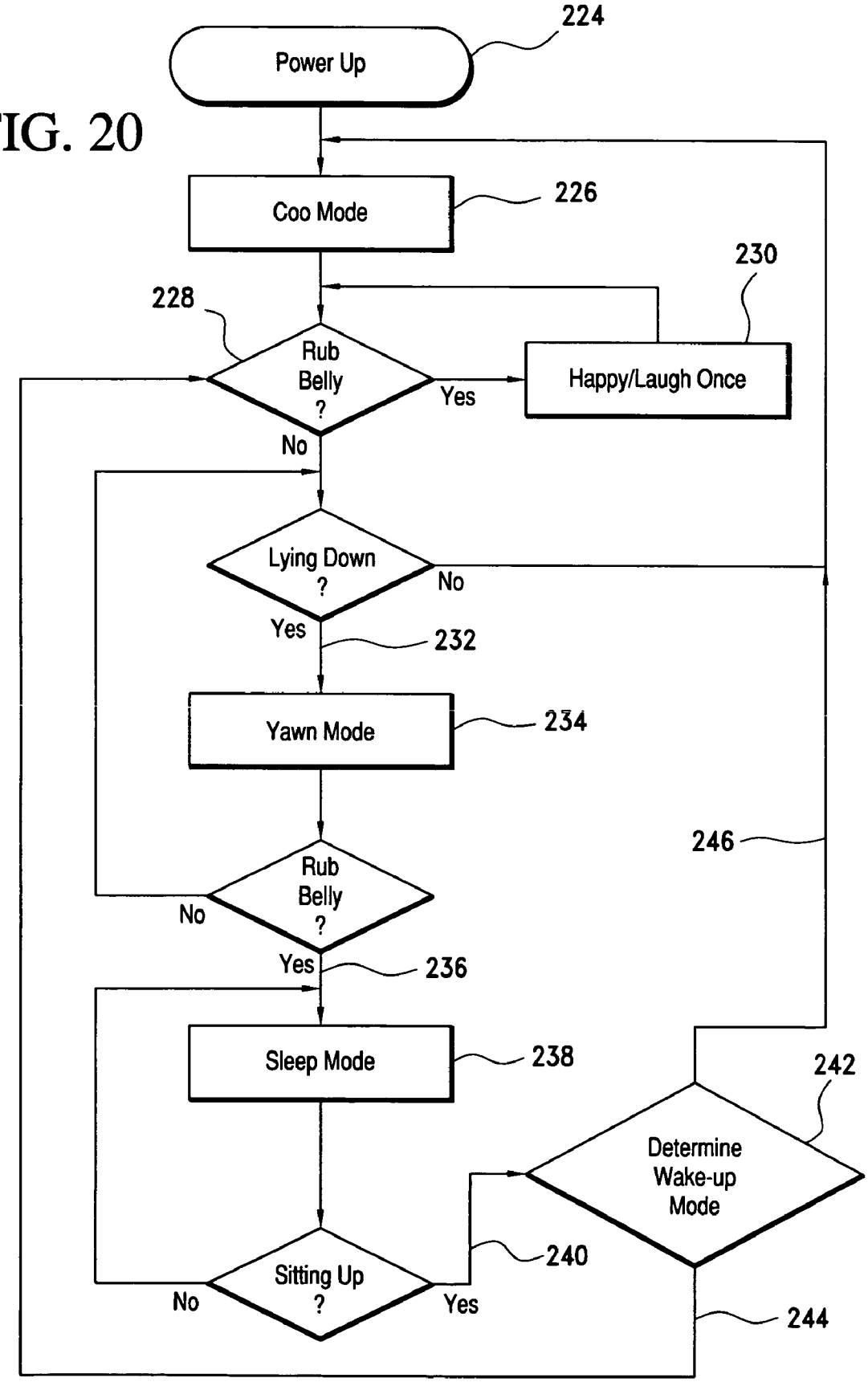
FIG. 20 illustrates a flow chart of a first embodiment of operation of a doll with the expression mechanism of the present invention.

In a first embodiment shown in FIG. 20, when the doll D is turned on, preferably by the ON-OFF switch 62 (step 224), it will assume a coo mode to make baby-talk sounds, while its mouth 20 moves slightly during talking (step 226). Preferably, at predetermined intervals, the doll's eyes 14 and 16 will blink which would be controlled by a microprocessor (not shown). The doll D would be capable of responding to touch by lightly pressing or rubbing chest or belly (step 228) to simulate tickling by laughing (step 230). In the laughing mode, the doll D will giggle and its mouth 20 will become animated as it switches back and forth between the smile and resting (neutral) positions. The doll D will also giggle (step 230) when her chest/belly area is rubbed or tickled (step 228). After the actuator ceases, i.e., pressing or rubbing of the chest or belly, the doll D will return to the baby-talk mode (step 226).

If the nipple of a bottle is placed on the doll's mouth 20, the lips 32 and 34 will move slightly and the doll D will make sucking sounds. The doll D will make a burping sound and return to the baby-talk mode, upon removal of the bottle.

If the doll D is placed lying down (step 232), it will start to yawn (step 234) with generally synchronous yawning sounds, and if her chest or belly is rubbed (step 236), the doll will fall asleep by closing her eyes 14 and 16 and then making soft breathing sounds (step 238).

The doll D remains sleeping until lifted upright (step 240) at which point the doll wakes up (step 242) in a crying or frown mode (step 244), but may alternatively wake up in the baby-talk mode (step 246). In the crying mode (step 244), it will open the eyes 14 and 16 and begin to make crying sounds. In this mode, the doll's mouth 20 would be animated switching back and forth between the neutral and pout or frown positions. The doll D may also make the crying sounds in this mode. However, upon rubbing the chest or belly area (step 228), the doll will calm down to giggle or laugh (step 230) and will return to the baby-talk mode (step 226). The frequencies of the doll D waking up in the baby-talk mode (step 246) and the crying or frown mode (step 244) are preferably set at 25% and 75%, respectively.

Figure 21:
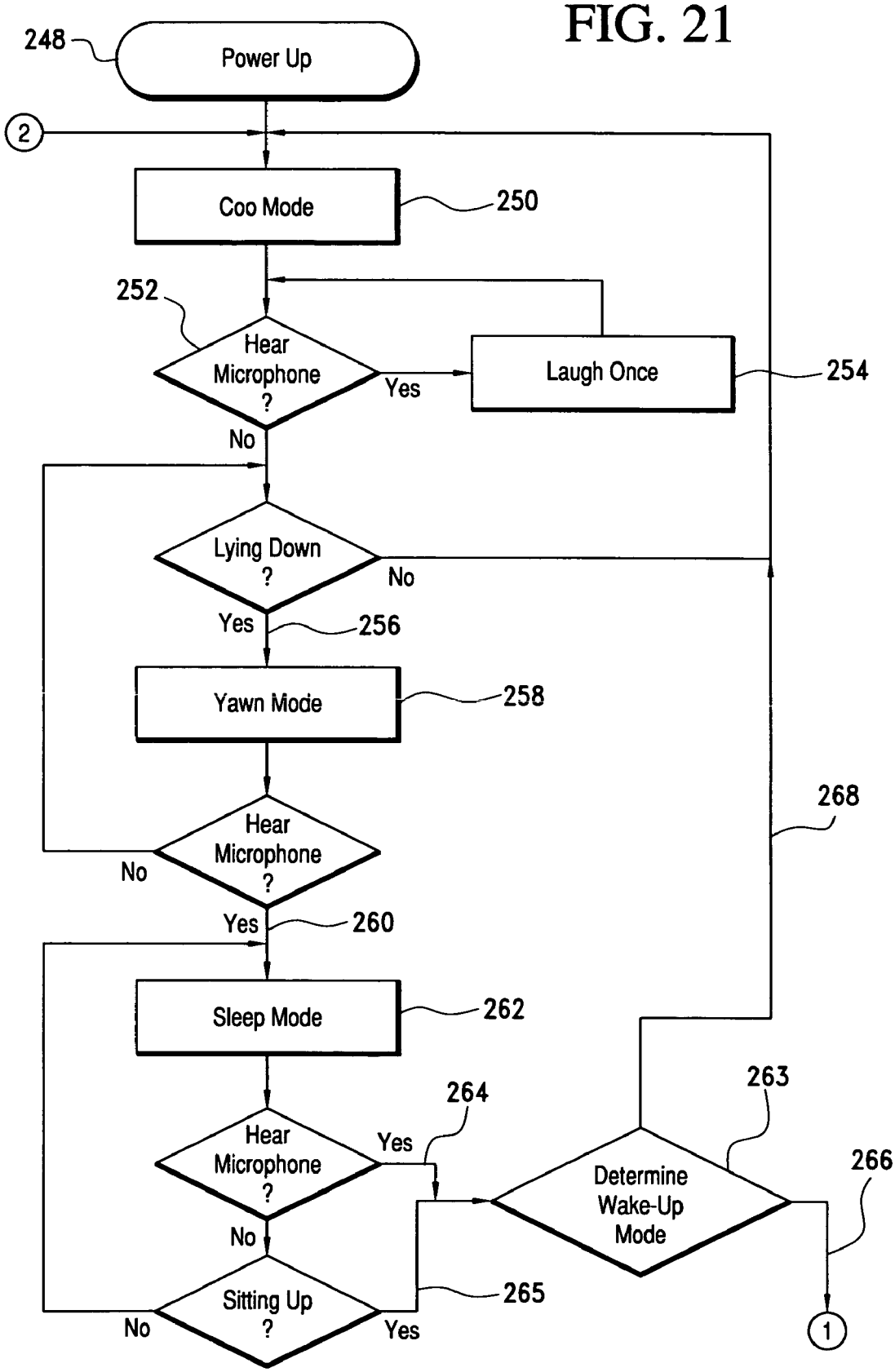
FIGS. 21-22 illustrate a flow chart of a second embodiment of operation of a doll with the expression mechanism of the present invention.
Figure 22:
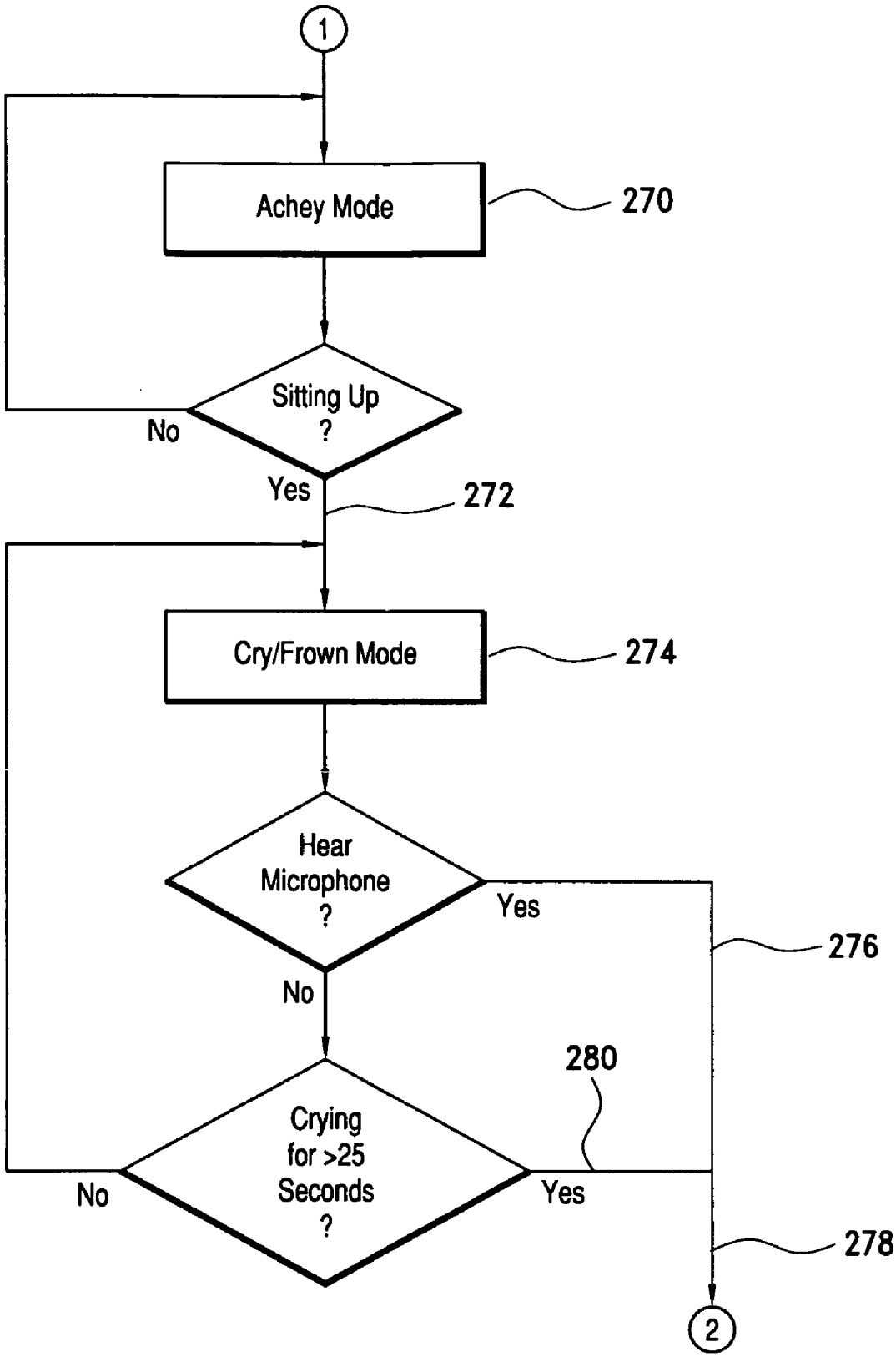

In a second embodiment shown in FIGS. 21-22, when the doll D is turned on, preferably by the ON-OFF switch 62 (step 248), it will assume a coo mode and make baby-talk sounds, while its mouth 20 moves slightly during talking (step 250). Preferably, at predetermined intervals, the doll's eyes 14 and 16 will blink which would be controlled by a microprocessor (not shown). The doll D would be capable of responding to an audio stimulus (step 252) received through the microphone 50, such as a child's voice or a toy rattle, to simulate laughing (step 254). In the laughing mode, the doll D will giggle and its mouth 20 will become animated as it switches back and forth between the smile and resting (neutral) positions.

If the nipple of a bottle is placed on the doll's mouth 20, the lips 32 and 34 will move slightly and the doll D will make sucking sounds. The doll D will make a burping sound and return to the baby-talk mode, upon removal of the bottle.

If the doll D is placed lying down (step 256), it will start to yawn (step 258) with generally synchronous yawning sounds, and upon receiving an audio stimulus through the microphone 50 (step 260), the doll D will fall asleep by closing her eyes and then making soft breathing sounds (step 262).

The doll will wake up (step 263) upon receiving an audio stimulus (step 264) or if lifted upright (step 265). Preferably, the doll wakes up in a cranky or frown mode (step 266), but may alternatively wake up in the baby-talk mode (step 268). In the frown or cranky mode, the doll's eyes 14 and 16 open and it makes moaning sounds (step 270), and when lifted up (step 272), it will assume the crying mode and begin to make crying sounds (step 274). In the crying mode, the doll's mouth 20 will be animated switching back and forth between the neutral and pout or frown positions. Once in the crying mode, upon receiving an audio stimulus (step 276), i.e., a child's voice or a rattle, the doll D will calm down and will return to the baby-talk mode and may giggle (step 278). The doll may also stop crying if the chest or belly is rubbed or tickled, or if a certain period of time has elapsed, for example, 25 seconds (step 280). The frequencies of the doll D waking-up in the baby-talk mode (step 268) and the cranky or frown mode (step 266) are preferably set at 25% and 75%, respectively.

It is noted that the above are merely examples of preferred embodiments of a doll incorporating the expression mechanism of the present invention. One of ordinary skill in the art would appreciate that many variations are possible and can be easily achieved by using the expression mechanism of the present invention in conjunction with a microprocessor or the like programmable device. For instance, the doll D could be programmed in a manner that the eyes are partially or fully closed, or blink during an expression. Likewise, the duration, frequency, etc., of the expression and/or opening-closing of the eyes could be programmed, as desired. In summary, the doll D of the invention can be programmed to coordinate, control, and/or synchronize various expressions in any way desired.

It is further noted that a doll made in accordance with the present invention can be controlled by a user to change its facial expressions and the associated sounds, through learned play patterns. For example, tickling or rubbing the doll can control when the doll laughs and when the doll stops laughing. As another example, a child can control when the doll wakes up and the doll always responds.

It is also noted that although the expression mechanism EM and the doll D of the present invention have been illustrated and described in terms of smile, frown, neutral, sleeping, yawning, etc., expressions, it is within the scope of the invention to simulate or mimic other expressions.

While this invention has been described as having preferred sequences, ranges, steps, materials, structures, components, features, and/or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbeforesetforth claims.

What is claimed is:

1. An expression mechanism for a toy having a lower lip, a cheek and an eye, comprising:

a) a first member for engaging the lower lip of a toy;

b) a second member in pivotable engagement with said first member for engaging a cheek of the toy;

c) a third member for opening or closing the eye of the toy;

d) said first member comprising a lip lever including first and second end portions;

e) said second member comprising a cheek lever including first and second end portions;

f) a motor for actuating one of said first and second members to cause the toy to simulate a facial expression;

g) a cam assembly operable by said motor;

h) said cam assembly including an output arm;

i) said output arm being in operable engagement with said cheek lever; and j) one of said first and second end portions of said cheek lever including a cam for engaging said output arm.

2. The expression mechanism of claim 1, wherein:

a) one of said first and second end portions of said lip lever is pivotally connected to the other of said first and second end portions of said cheek lever.

3. The expression mechanism of claim 1, wherein:

a) said cheek lever is generally U-shaped with a first opening;

b) said lip lever is generally U-shaped with a second opening, and;

c) said cheek and lip levers are connected in a manner that the first and second openings face each other.

4. The expression mechanism of claim 3, wherein:

a) the first opening is wider than the second opening such that said lip lever is positioned inwardly of said cheek lever.

5. The expression mechanism of claim 1, wherein:

a) said cam comprises a generally arcuate slot.

6. The expression mechanism of claim 1, wherein:

a) said motor actuates said one of first and second members, and said third member.

7. The expression mechanism of claim 6, wherein:

a) said third member comprises an eye linkage;

b) said cam assembly comprises a cam; and c) said eye linkage comprises an eye arm for engaging said cam.

8. The expression mechanism of claim 7, wherein:

a) said motor operates said output arm and said cam generally simultaneously to cause the toy to simulate at least one facial expression selected from the group consisting of smile, frown, sleeping, neutral, and a combination thereof.

9. The expression mechanism of claim 8, wherein:

a) the eye is generally closed in the frown position.

10. The expression mechanism of claim 8, wherein:

a) said motor comprises a servo motor.

11. The expression mechanism of claim 7, wherein:

a) said cam comprises a cam surface; and b) said eye arm is in sliding engagement with said cam surface.

12. The expression mechanism of claim 11, wherein:

a) said eye linkage comprises first and second end portions;

b) one of said first and second end portions of said eye linkage includes said eye arm; and c) the other of said first and second end portions of said eye linkage is in operable engagement with the eye.

13. The expression mechanism of claim 12, wherein:

a) said cam surface comprises a peak region and a valley region corresponding to the opening and closing positions of the eye, respectively.

14. The expression mechanism of claim 13, wherein:

a) said cam surface comprises a region corresponding to a blinking position of the eye.

15. The expression mechanism of claim 7, wherein:

a) said cam includes first and second sections extending in first and second planes, respectively.

16. The expression mechanism of claim 15, wherein:

a) said first and second planes extend generally at a right angle to each other.

17. A toy comprising the expression mechanism of claim 1.

18. An expression mechanism for a toy having a lower lip, a cheek and an eye, comprising:

a) a support frame;

b) a lip lever pivotally connected to said support frame for engaging the lower lip of a toy;

c) a cheek lever pivotally connected to said support frame for engaging a cheek of the toy;

d) an eye linkage for opening or closing the eye of the toy;

e) a motor for actuating one of said lip and cheek levers to cause the toy to simulate a facial expression; and f) said lip and cheek levers being interconnected in a manner that when said cheek lever pivots in one direction said lip lever pivots in a generally opposite directions.

19. The expression mechanism of claim 18, wherein:

a) said lip lever includes first and second end portions; and b) said cheek lever includes first and second end portions.

20. The expression mechanism of claim 19, further comprising:

a) a cam assembly operable by said motor;

b) said cam assembly including an output arm; and c) said output arm being in operable engagement with said cheek lever.

21. The expression mechanism of claim 20, wherein:

a) one of said first and second end portions of said cheek lever includes a cam for engaging said output arm.

22. The expression mechanism of claim 21, wherein:

a) one of said first and second end portions of said lip lever is pivotally connected to the other of said first and second end portions of said cheek lever.

23. The expression mechanism of claim 21, wherein:

a) said cheek lever is generally U-shaped with a first opening;

b) said lip lever is generally U-shaped with a second opening, and;

c) said cheek and lip levers are connected in a manner that the first and second openings face each other.

24. The expression mechanism of claim 23, wherein:

a) the first opening is wider than the second opening such that said lip lever is positioned inwardly of said cheek lever.

25. The expression mechanism of claim 21, wherein:

a) said cam comprises a generally arcuate slot.

26. The expression mechanism of claim 20, wherein:

a) said motor actuates said one of said lip and cheek levers, and said eye linkage.

27. The expression mechanism of claim 26, wherein:

a) said cam assembly comprises a cam; and b) said eye linkage comprises an eye arm for engaging said cam.

28. The expression mechanism of claim 27, wherein:

a) said cam comprises a cam surface; and b) said eye arm is in sliding engagement with said surface.

29. The expression mechanism of claim 28, wherein:

a) said eye linkage comprises first and second end portions;

b) one of said first and second end portions of said eye linkage includes said eye arm; and c) the other of said first and second end portions of said eye linkage is in operable engagement with the eye.

30. The expression mechanism of claim 29, wherein:

a) said cam surface comprises a peak region and a valley region corresponding to the opening and closing positions of the eye, respectively.

31. The expression mechanism of claim 30, wherein:

a) said cam surface comprises a region corresponding to a blinking position of the eye.

32. The expression mechanism of claim 27, wherein:

a) said cam includes first and second sections extending in first and second planes, respectively.

33. The expression mechanism of claim 32, wherein:

a) said first and second planes extend generally at a right angle to each other.

34. The expression mechanism of claim 27, wherein:

a) said motor operates said output arm and said cam generally simultaneously to cause the toy to simulate at least one facial expression selected from the group consisting of smile, frown, sleeping, neutral, and a combination thereof.

35. The expression mechanism of claim 34, wherein:

a) the eye is generally closed in the frown position.

36. The expression mechanism of claim 34, wherein:

a) said motor comprises a servo motor.

37. A toy comprising the expression mechanism of claim 18.

38. An expression mechanism for a toy having a lower lip and a cheek, comprising:

a) a lip lever for engaging the lower lip of a toy;

b) a cheek lever for engaging a cheek of the toy;

c) a motor for actuating one of said lip and cheek levers to cause the toy to simulate a facial expression; and d) said lip and cheek levers being interconnected in a manner to move in generally opposite directions.

39. The expression mechanism of claim 38, further comprising:

a) a support frame;

b) said lip lever being pivotally connected to said frame; and c) said cheek lever being pivotally connected to said frame.

40. The expression mechanism of claim 39, wherein:

a) said lip and cheek levers are interconnected in a manner to pivot in generally opposite directions.

41. A toy comprising the expression mechanism of claim 38.

42. A toy for simulating a facial expression including upper and lower lips, left and right cheeks and eyes, comprising:

a) a support inside the toy;

b) a lip lever pivotally connected to support and including front and rear end portions;

c) said front end portion of said lip lever being in operable engagement with the lower lip of the toy;

d) a cheek lever pivotally connected to said support and including front and rear end portions;

e) said cheek lever being in operable engagement with the left and right cheeks of the toy;

f) said rear end portion of said lip lever being in pivotable engagement with said front end portion of said cheek lever;

g) an eye linkage for opening or closing of the eyes;

h) a motor for actuating one of said lip and cheek levers; and i) said lip and cheek levers being interconnected in a manner that when said front end of said cheek lever moves upwardly, said front end of said lip lever moves downwardly.

43. The toy of claim 42, wherein:

a) said cheek lever moves the left and right cheeks upwardly when said front end thereof moves upwardly.

44. The toy of claim 43, wherein:

a) said lip lever moves the lower lip downwardly when said front end thereof moves downwardly.

45. The toy of claim 44, wherein:

a) the toy simulates a smile expression when said front end of said cheek lever moves upwardly.

46. The toy of claim 42, wherein:

a) said cheek lever moves the left and right cheeks downwardly when said front end thereof moves downwardly.

47. The toy of claim 46, wherein:

a) said lip lever moves the lower lip upwardly when said front end thereof moves upwardly.

48. The toy of claim 47, wherein:

a) the toy simulates a frown expression when said front end of said cheek lever moves downwardly.

49. The toy of claim 48, wherein:

a) the eyes are generally closed in the frown expression.

50. A method of causing a toy having a lower lip, a cheek and an eye, to simulate a facial expression, comprising the steps of:

a) providing an expression mechanism, comprising:

i) a first member for engaging the lower lip of a toy;

ii) a second member in pivotable engagement with the first member for engaging a cheek of the toy;

iii) a third member for opening or closing the eye of the toy;

iv) the first member comprising a lip lever including first and second end portions:

v) the second member comprising a cheek lever including first and second end portions;

vi) a motor for actuating one of the first and second members to cause the toy to simulate a facial expression;

vii) a cam assembly operable by the motor;

viii) the cam assembly including an output arm;

ix) the output arm being in operable engagement with the cheek lever; and x) one of the first and second end portions of the cheek lever including a cam for engaging the output arm;

b) actuating one of the first and second members to move the cheek and the lower lip to cause the toy to simulate a facial expression.

51. The method of claim 50, wherein:

the toy in step b) simulates at least one facial expression selected from the group consisting of smile, frown, sleeping, neutral, and a combination thereof.

52. An expression mechanism for a toy having a lower lip, a cheek and an eye, comprising:

a) a first member for engaging the lower lip of a toy;

b) a second member in pivotable engagement with said first member for engaging a cheek of the toy;

c) a third member for opening or closing the eye of the toy;

d) said first member comprising a lip lever including first and second end portions;

e) said second member comprising a cheek lever including first and second end portions;

f) a motor for actuating one of said first and second members to cause the toy to simulate a facial expression, and for actuating said third member;

g) a cam assembly operable by said motor;

h) said cam assembly including an output arm;

i) said output arm being in operable engagement with said cheek lever;

j) said third member comprising an eye linkage;

k) said cam assembly comprising a cam; and l) said eye linkage comprising an eye arm for engaging said cam.

53. The expression mechanism of claim 52, wherein:

a) said cam comprises a cam surface; and b) said eye arm is in sliding engagement with said cam surface.

54. The expression mechanism of claim 53, wherein:

a) said eye linkage comprises first and second end portions;

b) one of said first and second end portions of said eye linkage includes said eye arm; and c) the other of said first and second end portions of said eye linkage is in operable engagement with the eye.

55. The expression mechanism of claim 54, wherein:

a) said cam surface comprises a peak region and a valley region corresponding to the opening and closing positions of the eye, respectively.

56. The expression mechanism of claim 55, wherein:

a) said cam surface comprises a region corresponding to a blinking position of the eye.

57. The expression mechanism of claim 52, wherein:

a) said cam includes first and second sections extending in first and second planes, respectively.

58. The expression mechanism of claim 57, wherein:

a) said first and second planes extend generally at a right angle to each other.

59. The expression mechanism of claim 52, wherein:

a) said motor operates said output arm and said cam generally simultaneously to cause the toy to simulate at least one facial expression selected from the group consisting of smile, frown, sleeping, neutral, and a combination thereof.

60. The expression mechanism of claim 59, wherein:

a) the eye is generally closed in the frown position.

61. The expression mechanism of claim 59, wherein:

a) said motor comprises a servo motor.

62. A toy comprising the expression mechanism of claim 52.

* * * * *